US010619833B2

(12) United States Patent
Yao et al.

(10) Patent No.: US 10,619,833 B2
(45) Date of Patent: Apr. 14, 2020

(54) CURVED LED TUBULAR LAMP

(71) Applicant: ZHEJIANG SUPER LIGHTING ELECTRIC APPLIANCE CO., LTD, Jinyun (CN)

(72) Inventors: Wentao Yao, Jiaxing (CN); Weijun Zhu, Jiaxing (CN); Zhaosong Lin, Jiaxing (CN); Zhi Guo, Jiaxing (CN)

( * ) Notice: Subject to any disclaimer, the term of this patent is extended or adjusted under 35 U.S.C. 154(b) by 0 days.

(21) Appl. No.: 16/296,262

(22) Filed: Mar. 8, 2019

(65) Prior Publication Data

US 2019/0203916 A1 Jul. 4, 2019

Related U.S. Application Data

(63) Continuation of application No. 15/441,592, filed on Feb. 24, 2017, now Pat. No. 10,288,272.

(30) Foreign Application Priority Data

Mar. 17, 2016 (CN) ..... 2016 1 0152885
Mar. 18, 2016 (CN) ..... 2016 2 0209317 U
(Continued)

(51) Int. Cl.
*F21V 23/00* (2015.01)
*F21V 3/06* (2018.01)
(Continued)

(52) U.S. Cl.
CPC ..... *F21V 23/005* (2013.01); *F21K 9/272* (2016.08); *F21V 3/061* (2018.02); *F21V 7/005* (2013.01);
(Continued)

(58) Field of Classification Search
CPC ..... F21Y 2103/37; F21K 9/27; F21K 9/275; F21K 9/278
See application file for complete search history.

(56) References Cited

U.S. PATENT DOCUMENTS 6,246,167 B1 6/2001 Sica
7,067,032 B1 6/2006 Bremont et al.
(Continued)

FOREIGN PATENT DOCUMENTS

CN 1292930 A 4/2001
CN 2498692 Y 7/2002
(Continued)

*Primary Examiner* — Alexander K Garlen
(74) *Attorney, Agent, or Firm* — Simon Kuang Lu

(57) ABSTRACT

This present invention provides a Curved LED tubular lamp, comprising a Curved lamp tube as mentioned above, wherein the first straight tube has a first inner wall and a first outer wall opposite to the first inner wall along the longitudinal axis of the first straight tube, and the second straight tube has a second inner wall and a second outer wall opposite to the second inner wall along the longitudinal axis of the second straight tube, and the rear supporter has a third inner wall and a third outer wall opposite to the third inner wall along the axis of the rear supporter, whereby the first inner wall, the third inner wall and the second inner wall is defined as an inner area, and the first outer wall, the third outer wall and the second outer wall is defined as an outer area; a LED light board installed on the inner area of the Curved lamp tube; two lamp caps respectively capped on the front ends of the first straight tube and the second straight tube, and connected with each other by a first front supporter; and driving circuits formed inside the caps or on the LED light board and interconnected to the LED light board.

6 Claims, 20 Drawing Sheets

(30) Foreign Application Priority Data

Aug. 4, 2016 (CN) ..... 2016 1 0642281
Aug. 19, 2016 (CN) ..... 2016 1 0700677

(51) Int. Cl.

| | |
|---|---|
| ***F21K 9/272*** | (2016.01) |
| ***F21V 29/85*** | (2015.01) |
| ***F21V 7/00*** | (2006.01) |
| ***F21V 15/015*** | (2006.01) |
| ***F21V 17/10*** | (2006.01) |
| ***F21V 25/02*** | (2006.01) |
| ***F21Y 103/37*** | (2016.01) |
| ***F21Y 107/70*** | (2016.01) |
| ***F21Y 103/10*** | (2016.01) |
| ***F21Y 115/10*** | (2016.01) |

(52) U.S. Cl.

CPC ..... *F21V 15/015* (2013.01); *F21V 17/101* (2013.01); *F21V 25/02* (2013.01); *F21V 29/85* (2015.01); *F21Y 2103/10* (2016.08); *F21Y 2103/37* (2016.08); *F21Y 2107/70* (2016.08); *F21Y 2115/10* (2016.08)

(56) References Cited

U.S. PATENT DOCUMENTS

| | | | | |
|---|---|---|---|---|
| 7,594,738 | B1 | 9/2009 | Lin et al. | |
| 7,611,260 | B1 | 11/2009 | Lin | |
| 7,815,338 | B2 | 10/2010 | Siemiet et al. | |
| 8,240,875 | B2 | 8/2012 | Roberts et al. | |
| 8,360,599 | B2 | 1/2013 | Ivey et al. | |
| 8,456,075 | B2 | 6/2013 | Axelsson | |
| 9,000,668 | B2 | 4/2015 | Qiu | |
| 9,322,531 | B2 | 4/2016 | Liang et al. | |
| 9,448,660 | B2 | 9/2016 | Seo et al. | |
| 9,625,137 | B2 | 4/2017 | Li et al. | |
| 9,864,438 | B2 | 1/2018 | Seo et al. | |
| 9,885,449 | B2 | 2/2018 | Jiang | |
| 10,021,742 | B2 | 7/2018 | Jiang | |
| 10,288,272 | B2 | 5/2019 | Yao et al. | |
| 2003/0189829 | A1 | 10/2003 | Shimizu et al. | |
| 2004/0095078 | A1* | 5/2004 | Leong | H05B 33/0809 315/291 |
| 2004/0189218 | A1 | 9/2004 | Leong | |
| 2005/0162101 | A1 | 7/2005 | Leong et al. | |
| 2005/0162850 | A1 | 7/2005 | Luk | |
| 2005/0185396 | A1 | 8/2005 | Kutler | |
| 2005/0281030 | A1* | 12/2005 | Leong | F21V 23/0471 362/234 |
| 2007/0001709 | A1 | 1/2007 | Shen | |
| 2008/0055894 | A1 | 3/2008 | Deng et al. | |
| 2008/0192476 | A1 | 8/2008 | Hiratsuka | |
| 2008/0290814 | A1 | 11/2008 | Leong | |
| 2009/0040415 | A1 | 2/2009 | Kim | |
| 2009/0159919 | A1 | 6/2009 | Simon et al. | |
| 2009/0219713 | A1 | 9/2009 | Siemiet et al. | |
| 2010/0066230 | A1 | 3/2010 | Lin et al. | |
| 2010/0124054 | A1 | 5/2010 | Chen et al. | |
| 2010/0188001 | A1* | 7/2010 | Broitzman | H05B 33/0803 315/113 |
| 2010/0201269 | A1 | 8/2010 | Tzou et al. | |
| 2010/0220469 | A1 | 9/2010 | Ivey et al. | |
| 2010/0253226 | A1 | 10/2010 | Oki | |
| 2010/0277918 | A1 | 11/2010 | Chen | |
| 2011/0038146 | A1 | 2/2011 | Chen | |
| 2011/0084554 | A1 | 4/2011 | Tian | |
| 2011/0084608 | A1 | 4/2011 | Lin et al. | |
| 2011/0084627 | A1 | 4/2011 | Sloan et al. | |
| 2011/0149563 | A1 | 6/2011 | Hsia et al. | |
| 2011/0175536 | A1 | 7/2011 | Fujita et al. | |
| 2011/0279063 | A1 | 11/2011 | Wang et al. | |
| 2011/0305021 | A1 | 12/2011 | Xin | |
| 2011/0309745 | A1 | 12/2011 | Westermarck et al. | |
| 2012/0049684 | A1 | 3/2012 | Bodenstein et al. | |
| 2012/0051039 | A1 | 3/2012 | Chang | |
| 2012/0069556 | A1 | 3/2012 | Bertram et al. | |
| 2012/0146503 | A1 | 6/2012 | Negley et al. | |
| 2012/0212951 | A1 | 8/2012 | Lai et al. | |
| 2012/0319150 | A1 | 12/2012 | Shimomura et al. | |
| 2013/0021809 | A1 | 1/2013 | Dellian et al. | |
| 2013/0033881 | A1 | 2/2013 | Terazawa et al. | |
| 2013/0033888 | A1 | 2/2013 | Van Der Wel et al. | |
| 2013/0050998 | A1 | 2/2013 | Chu et al. | |
| 2013/0051008 | A1 | 2/2013 | Shew | |
| 2013/0069538 | A1 | 3/2013 | So | |
| 2013/0135852 | A1 | 5/2013 | Chan et al. | |
| 2013/0135857 | A1 | 5/2013 | Chen et al. | |
| 2013/0141890 | A1 | 6/2013 | Carlin et al. | |
| 2013/0215609 | A1 | 8/2013 | Liu et al. | |
| 2013/0223053 | A1 | 8/2013 | Liu et al. | |
| 2013/0229104 | A1* | 9/2013 | Green | F21V 29/70 313/46 |
| 2013/0230995 | A1 | 9/2013 | Ivey et al. | |
| 2013/0235570 | A1 | 9/2013 | Hood et al. | |
| 2013/0250565 | A1 | 9/2013 | Chiang et al. | |
| 2013/0256704 | A1 | 10/2013 | Hsiao | |
| 2013/0258650 | A1 | 10/2013 | Sharrah | |
| 2013/0293098 | A1 | 11/2013 | Li et al. | |
| 2013/0301255 | A1 | 11/2013 | Kim et al. | |
| 2014/0009923 | A1 | 1/2014 | Wu | |
| 2014/0153231 | A1 | 6/2014 | Bittmann | |
| 2014/0192526 | A1 | 7/2014 | Qiu | |
| 2014/0203717 | A1 | 7/2014 | Zhang | |
| 2014/0225519 | A1 | 8/2014 | Yu et al. | |
| 2014/0331532 | A1 | 11/2014 | Deppiesse | |
| 2015/0070885 | A1 | 3/2015 | Petro et al. | |
| 2015/0176770 | A1 | 6/2015 | Wilcox et al. | |
| 2015/0345755 | A1 | 12/2015 | Purdy | |
| 2016/0081147 | A1 | 3/2016 | Guang | |
| 2016/0091147 | A1 | 3/2016 | Jiang et al. | |
| 2017/0059096 | A1 | 3/2017 | Xu et al. | |
| 2017/0290119 | A1 | 10/2017 | Xiong et al. | |

FOREIGN PATENT DOCUMENTS

| | | | |
|---|---|---|---|
| CN | 1460165 | A | 12/2003 |
| CN | 1914458 | A | 2/2007 |
| CN | 2911390 | Y | 6/2007 |
| CN | 200980183 | Y | 11/2007 |
| CN | 101092545 | A | 12/2007 |
| CN | 201014273 | Y | 1/2008 |
| CN | 101182919 | A | 5/2008 |
| CN | 101228393 | A | 7/2008 |
| CN | 201255393 | Y | 6/2009 |
| CN | 201363601 | Y | 12/2009 |
| CN | 201437921 | U | 4/2010 |
| CN | 101787273 | A | 7/2010 |
| CN | 101806444 | A | 8/2010 |
| CN | 201555053 | U | 8/2010 |
| CN | 102016661 | A | 4/2011 |
| CN | 201796567 | U | 4/2011 |
| CN | 201866575 | U | 6/2011 |
| CN | 102116460 | A | 7/2011 |
| CN | 102121690 | A | 7/2011 |
| CN | 102159867 | A | 8/2011 |
| CN | 201954169 | U | 8/2011 |
| CN | 201954350 | U | 8/2011 |
| CN | 20215774 | U | 1/2012 |
| CN | 202100985 | U | 1/2012 |
| CN | 202120982 | U | 1/2012 |
| CN | 102359697 | A | 2/2012 |
| CN | 202132647 | U | 2/2012 |
| CN | 102376843 | A | 3/2012 |
| CN | 202216003 | U | 5/2012 |
| CN | 102518972 | A | 6/2012 |
| CN | 202281101 | U | 6/2012 |
| CN | 202302841 | U | 7/2012 |
| CN | 202392485 | U | 8/2012 |
| CN | 102720901 | A | 10/2012 |
| CN | 102738355 | A | 10/2012 |
| CN | 102777788 | A | 11/2012 |
| CN | 202546288 | U | 11/2012 |

(56) References Cited

FOREIGN PATENT DOCUMENTS

| | | | |
|---|---|---|---|
| CN | 202546330 | U | 11/2012 |
| CN | 102889446 | A | 1/2013 |
| CN | 103016984 | A | 4/2013 |
| CN | 202852551 | U | 4/2013 |
| CN | 202884614 | U | 4/2013 |
| CN | 103195999 | A | 7/2013 |
| CN | 203036285 | U | 7/2013 |
| CN | 203068187 | U | 7/2013 |
| CN | 203131520 | U | 8/2013 |
| CN | 203162856 | U | 8/2013 |
| CN | 203202766 | U | 9/2013 |
| CN | 203240337 | U | 10/2013 |
| CN | 203240362 | U | 10/2013 |
| CN | 2034240362 | U | 10/2013 |
| CN | 103411140 | A | 11/2013 |
| CN | 203464014 | U | 3/2014 |
| CN | 103742875 | A | 4/2014 |
| CN | 203517629 | U | 4/2014 |
| CN | 203549435 | U | 4/2014 |
| CN | 103822121 | A | 5/2014 |
| CN | 203615157 | U | 5/2014 |
| CN | 103851547 | A | 6/2014 |
| CN | 103943752 | A | 7/2014 |
| CN | 203686635 | U | 7/2014 |
| CN | 103968272 | A | 8/2014 |
| CN | 203771102 | U | 8/2014 |
| CN | 104033772 | A | 9/2014 |
| CN | 203848055 | U | 9/2014 |
| CN | 203857296 | U | 10/2014 |
| CN | 203927469 | U | 11/2014 |
| CN | 203963553 | U | 11/2014 |
| CN | 204042527 | U | 12/2014 |
| CN | 204083927 | U | 1/2015 |
| CN | 104515014 | A | 4/2015 |
| CN | 104565931 | A | 4/2015 |
| CN | 204268162 | U | 4/2015 |
| CN | 204300737 | U | 4/2015 |
| CN | 103411140 | B | 5/2015 |
| CN | 104595765 | A | 5/2015 |
| CN | 204420636 | U | 6/2015 |
| CN | 104776332 | A | 7/2015 |
| CN | 104832813 | A | 8/2015 |
| CN | 204534210 | U | 8/2015 |
| CN | 204573639 | U | 8/2015 |
| CN | 204573682 | U | 8/2015 |
| CN | 204573684 | U | 8/2015 |
| CN | 204573700 | U | 8/2015 |
| CN | 204693095 | U | 10/2015 |
| CN | 204879985 | U | 12/2015 |
| CN | 104033772 | B | 6/2016 |
| CN | 205447315 | U | 8/2016 |
| CN | 205877791 | U | 1/2017 |
| DE | 202012011550 | U1 | 6/2013 |
| EP | 2554899 | A2 | 2/2013 |
| EP | 3146803 | A1 | 3/2017 |
| GB | 2519258 | A | 4/2015 |
| GB | 2523275 | A | 8/2015 |
| GB | 2531425 | A | 4/2016 |
| JP | 2005122906 | A | 5/2005 |
| JP | 2008117666 | A | 5/2008 |
| JP | 3147313 | U | 12/2008 |
| JP | 2011061056 | A | 3/2011 |
| JP | 2013254667 | A | 12/2013 |
| JP | 2014154479 | A | 8/2014 |
| KR | 20090118147 | A | 11/2009 |
| KR | 20120055349 | A | 5/2012 |
| WO | 2009111098 | A2 | 9/2009 |
| WO | 2012129301 | A1 | 9/2012 |
| WO | 2013125803 | A1 | 8/2013 |
| WO | 2014045523 | A1 | 3/2014 |
| WO | 2014117435 | A1 | 8/2014 |
| WO | 2014118754 | A1 | 8/2014 |
| WO | 2015081809 | A1 | 6/2015 |
| WO | 2016086900 | A2 | 6/2016 |
| WO | 2016086901 | A3 | 6/2016 |

* cited by examiner

2 { 2A, 2B }

CURVED LED TUBULAR LAMP

CROSS-REFERENCE TO RELATED APPLICATIONS

This application is a continuation application of U.S. application Ser. No. 15/441,592 filed on 2017 Feb. 24, which claims the benefit of CN application No. 201610152885.6 filed on Mar. 17, 2016; CN application No. 201620209317.0 filed on Mar. 18, 2016; CN application No. 201610642281.X filed on Aug. 4, 2016, and CN application No. 201610700677.5 filed on Aug. 19, 2016, and the entirety of which are incorporated by reference herein.

FIELD OF THE INVENTION

The present invention relates to a LED lamp and in particular relates to a LED tubular lamp having a curved body.

Description of the Related Art

Curved LED tubular lamps are widely used to replace conventional incandescent lamps in the market because of their advantages including long life-time, small size and power saving. All plastic tube is a common design in conventional curved LED tubular lamps, but it suffer from poor heat dissipation. In order to resolve above-mentioned problem, a heat-dissipation housing made of a combination of aluminum alloy and plastic cover was used, and the light source of the curved LED tubular lamp consisted of a LED array having a plurality of singular LED welded on a circuit board was fasten on the heat dissipation housing. As disclosed in the FIG. 12 of US patent publication no. 2015/0223301A1, the illustrated driver-less LED lighting device is a curved LED tubular lamp. The two LED arrays 301 each is on one of the two prongs. Each LED array 301 in on a PCB board 302, which itself in on top of the heat-sink 303 which also functions as a housing to the prong. Each prong also has a lens cover 304. There is one curved plastic connector 305*a* (top) and 305*b* (bottom) on one end to connect two prongs. There is a pin-socket assembly 306 that has two pairs of G13 bi-pin for inserting into the G-13 socket of a curved tube fixture. However, this kind of design is prone to cause electrical shock owing to the heat-dissipation housing contains aluminum alloy which is a good conductor, and the poor light transmittance of either plastic cover or plastic tube will reduce the luminous efficiency. Besides, a dark zone (i.e. non-emitting segment having no LEDs disposed therein) will appear in the region of the plastic connector of the curved LED tubular lamp since there is no LED array disposed therein.

In addition, the light boards of the conventional curved LED tubular lamps are usually made of rigid printed circuit board (PCB), which is hard to be stretched. Therefore, a rigid board without LED formed thereon or a wiring is placed in the connecting bar connecting two straight tube of the curved LED tubular lamp. This would result in a dark zone existing in the connecting bar of the curved LED tubular lamp. Besides, the heat dissipation rate of the rigid PCB is poor, so a heat sink structure placed outside the LED tubular lamp is necessary. The additional heat sink will enhance the cost of the LED tubular lamp. Moreover, the rigid PCB or wire placed in the connecting bar is easily shook or broken owing to lack of suitable positioning and guiding structures, which will affect the luminous efficiency of the curved LED tubular lamps. In order to resolve above-mentioned problems, the rigid PCBs are replaced with flexible light boards to avoid the problem of a dark zone existing in the connecting bar of the curved LED tubular lamp. However, the flexible light board is easily warped in the connecting bar of the curved LED tubular lamp, and the warpage will also affect the light efficiency of the LED tubular lamp. In order to resolve above-mentioned problems, a novel curved LED tubular lamp is provided.

SUMMARY OF THE INVENTION

A feature of this invention provides a curved LED tubular lamp, comprising: a curved lamp tube having two straight segments and a curve segment disposed between the two straight segments; at least one flexible substrate where a plurality of LEDs mounted on thereof, and at least one positioning pillar formed on the inner surface of the curve segment of the curved lamp tube, wherein each of the two straight segments and the curve segment have LEDs disposed therein, and wherein the flexible substrate is disposed in at least the curve segment.

Another feature of this invention provides a curved LED tubular lamp as mentioned above, wherein the flexible substrate is assembled and positioned by bending through the positioning pillars.

Another feature of this invention provides a curved LED tubular lamp as mentioned above, wherein the flexible substrate comprises at least one positioning hole corresponding to the positioning pillar, and the flexible substrate is positioned by inserting the pillars into the corresponding positioning hole.

Another feature of this invention provides a curved LED tubular lamp as mentioned above, wherein the curved LED tubular lamp is assembled by two straight tubes and a rear supporter disposed between the two straight tubes, and the rear supporter has two installing parts at the end thereof for respectively joining one terminal of the straight tube; a connecting part having a straight shape and located between the two installing parts; and two transition parts having a curved shape, located between and connect the installing parts and the connecting part; wherein the installing part has at least one protruding rib for forming glue-coating space.

Another feature of this invention provides a curved LED tubular lamp as mentioned above, wherein the rear supporter has a baffle board in the installing parts for positioning the straight tubes.

Another feature of this invention provides a curved LED tubular lamp as mentioned above, wherein the rear supporter is assembled from two pieces respectively having a buckle and a hook thereon.

Another feature of this invention provides a curved LED tubular lamp as mentioned above, wherein the rear supporter has a plurality of rib boards formed in the connecting part and spaced from each other, each of the rib boards comprise a positioning groove corresponding to the width of the flexible substrate.

Another feature of this invention provides a curved LED tubular lamp as mentioned above, wherein the rear supporter has a positioning protrusion extending from one side of the inner wall of the rear supporter and toward but keep a space from the other side of the inner wall of the rear supporter.

Another feature of this invention provides a curved LED tubular lamp as mentioned above, wherein the curved LED tubular lamp further comprises one or two driving circuits, disposed in one or both of the straight segments of the curved LED tubular lamp.

Another feature of this invention provides A curved LED tubular lamp, comprising: a curved lamp tube having two straight segments and a curve segment disposed between the two straight segments; and at least one flexible substrate where a plurality of LEDs mounted on thereof, wherein each of the two straight segments and the curve segment have LEDs disposed therein, wherein the flexible substrate is disposed in at least the curve segment, and wherein the flexible substrate have a plurality of spacers to form notches thereon.

Another feature of this invention provides a curved LED tubular lamp as mentioned above, wherein the flexible substrate has a fitting part attached on the inner wall of the curve segment of the curved lamp, and a placing part, including a plurality of placing pieces with at least one LED formed thereon installed.

Another feature of this invention provides a curved LED tubular lamp as mentioned above, wherein the placing pieces and the spacers have the same shape.

Another feature of this invention provides a curved LED tubular lamp as mentioned above, the flexible substrate further comprises a reflector extended from the fitting part or the placing piece to reflect the light emitted by at least one of the LEDs to enhance the luminance of the curved LED tubular lamp.

Another feature of this invention provides a curved LED tubular lamp as mentioned above, the flexible substrate is separated into at least two segments.

Another feature of this invention provides a curved LED tubular lamp as mentioned above, wherein the curved LED tubular lamp further comprises one or two driving circuits, disposed in one or both of the straight segments of the curved LED tubular lamp.

Another feature of this invention provides a curved LED tubular lamp as mentioned above, wherein the curved LED tubular lamp is assembled by two straight tubes and a rear supporter disposed between the two straight tubes, and the rear supporter is assembled from two pieces respectively having a protruded edge and a trench extend along the edge thereof.

A feature of this invention provides a curved LED tubular lamp, comprising: a curved lamp tube having two straight segments and a curve segment disposed between the two straight segments; at least one flexible substrate where a plurality of LEDs mounted thereon; a plurality of rib boards formed spaced from each other in the curve segment; wherein each of the two straight segments and the curve segment have LEDs installed therein, and wherein the flexible substrate is disposed in at least the curve segment.

Another feature of this invention provides a curved LED tubular lamp as mentioned above, wherein the curved LED tubular lamp is assembled by two straight tubes and a rear supporter disposed between the two straight tubes, the rear supporter has a plurality of rib boards formed in the connecting part and spaced from each other, each of the rib boards comprise a positioning groove corresponding to the width of the flexible substrate.

Another feature of this invention provides a curved LED tubular lamp as mentioned above, wherein the rear supporter has a baffle board in the installing parts for positioning the straight tubes.

Another feature of this invention provides a curved LED tubular lamp as mentioned above, wherein the rear supporter is assembled from two pieces respectively having a buckle and a hook thereon.

Another feature of this invention provides a curved LED tubular lamp as mentioned above, wherein the rear supporter has a positioning protrusion extending from one side of the inner wall of the rear supporter and toward but keep a space from the other side of the inner wall of the rear supporter.

Another feature of this invention provides a curved LED tubular lamp as mentioned above, wherein the rear supporter has: two installing parts at the end thereof for respectively joining one terminal of the straight tube; a connecting part having a straight shape and located between the two installing parts; two transition parts having a curved shape, located between and connect the installing parts and the connecting part, and at least one positioning pillar formed within the transition parts.

Another feature of this invention provides a curved LED tubular lamp as mentioned above, wherein the curved LED tubular lamp further comprises one or two driving circuits, disposed in one or both of the straight segments of the curved LED tubular lamp.

Another feature of this invention provides a curved LED tubular lamp as mentioned above, wherein the curved LED tubular lamp further comprises two lamp casing capped at the end of the straight tubes, wherein a pair of groove respectively formed on the two lamp casing.

DETAILED DESCRIPTION OF THE INVENTION

The making and using of the embodiments of the present disclosure are discussed in detail below. However, it should be noted that the embodiments provide many applicable inventive concepts that can be embodied in a variety of specific methods. The specific exemplary embodiments discussed are merely illustrative of specific methods to make and use the embodiments, and do not limit the scope of the disclosure.

Figure 1:
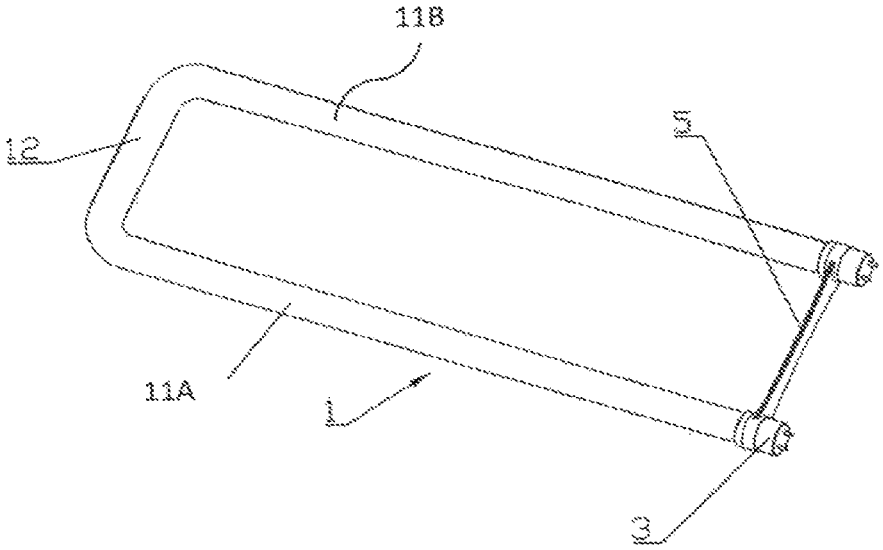
FIG. 1 is a perspective view of a curved LED tubular lamp of the embodiment 1 of this invention.
Figure 2:
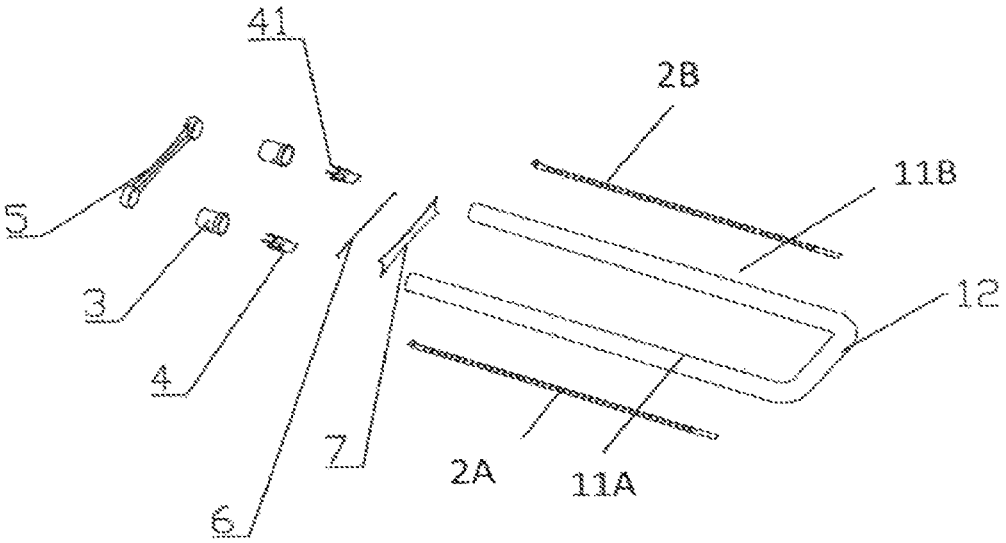
FIG. 2 is an exploded view of the curved LED tubular lamp as illustrated in FIG. 1.

Exemplary Embodiment 1:

A curved LED tubular lamp of the embodiment 1 of this invention is illustrated in FIGS. 1 to 2. The curved LED tubular lamp comprises a lamp tube 1, a LED light board 2, a lamp cap 3, and a driving circuit 4.

The curved lamp tube 1 of this embodiment is an integrated glass tube comprising two straight tubes 11A, 11B, and a rear supporter 12, wherein the rear supporter 12 is located between the straight tubes 11A and 11B and integrated with the straight tubes 11A and 11B to form a curved lamp tube 1 as shown in FIG. 1. The heat dissipation property of the glass tube of this embodiment is better than that of the plastic light tube, so the heat generated by the LEDs formed on the LED light board 2 can be efficiently dissipated into air through the glass tube. Accordingly, the luminous efficiency of the curved LED tubular lamp can be highly enhanced. In addition, the curved lamp tube 1 made of an integrated glass tube possesses the advantages of easily processed, attractive appearance and durable.

The LED light board 2 with a plurality of LEDs formed thereon comprises a first light bar 2A and a second light bar 2B, wherein the first light bar 2A and the second light bar 2B are respectively attached on the inner wall of straight tubes 11A and 11B by means of a glue such as silicone or other glues with a function of good heat dissipation, or a linear silicone tape. According to other embodiments of this invention, the curved LED tubular lamp can further comprise a middle connecting segment (not shown) with a plurality of LEDs formed thereon, wherein the middle connecting segment (not shown) is interconnected to the first light bar 2A and the second light bar 2B and installed in the rear supporter 12 to generate a curved LED tubular lamp without a dark zone. Preferably, the first light bar 2A, the second light bar 2B and the middle connecting segment (not shown) are flexible boards with a plurality of LEDs formed thereon.

Figure 4:
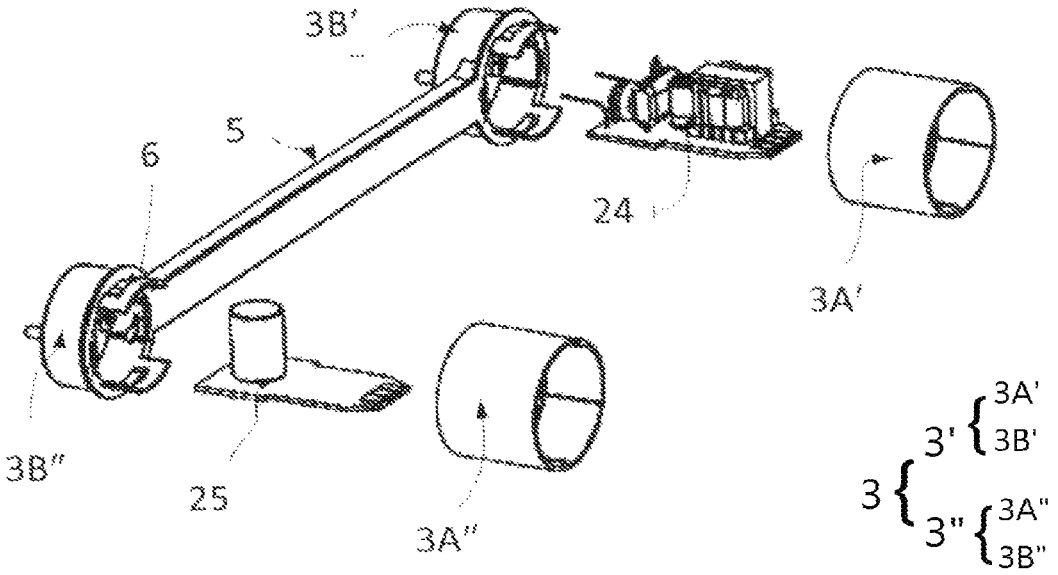
FIG. 4 is a perspective view of a structure, which is capable of being used in the curved LED tubular lamp of the embodiment 1, assembled as a whole by the first front supporter and the lamp caps of the embodiment 1 of this invention.

As shown in FIGS. 1-2, the lamp caps 3 are capped on the front terminals of straight tubes 11A and 11B, and a driving circuit 4 is encapsulated inside the lamp cap 3, wherein one end of the driving circuit 4 is a metal pin 41 protruded out of the lamp cap 3, and the other end of the driving circuit 4 is interconnected to the LED light board 2 by welding or plugging. The driving circuit 4 of other embodiments of this invention can also be formed on the LED light board 2 instead encapsulated inside the lamp cap 3, and the metal ping 41 of the driving circuit 4 is fastened on the LED light board 2. The driving circuits 4 may be disposed in both of the two lamp caps 3 as shown in FIG. 2, or may be only disposed in one of the two lamp caps 3, as shown in FIG. 4.

As shown in FIGS. 1-2, a first front supporter 5 can be further formed between those two lamp caps 3 to enhance the stability of the whole curved LED tubular lamp. The lamp caps 3 and the first front supporter 5 can be integrated as a whole as shown in FIGS. 1-2 or assembled as a whole.

As shown in FIGS. 1-2, the driving circuits 4 are interconnected by a conductive connector 6 like a wire. The two driving circuits 4 may share the power supply of the curved LED tubular lamp thus overheat of the driving circuit can be prevented. Moreover, the first front supporter 5 further comprises a second front supporter 7, and the conductive connector 6 is sandwiched and hided between the first front supporter 5 and the second front supporter 7 to avoid electric shock caused by the exposed conductive connector 6.

Figure 3:
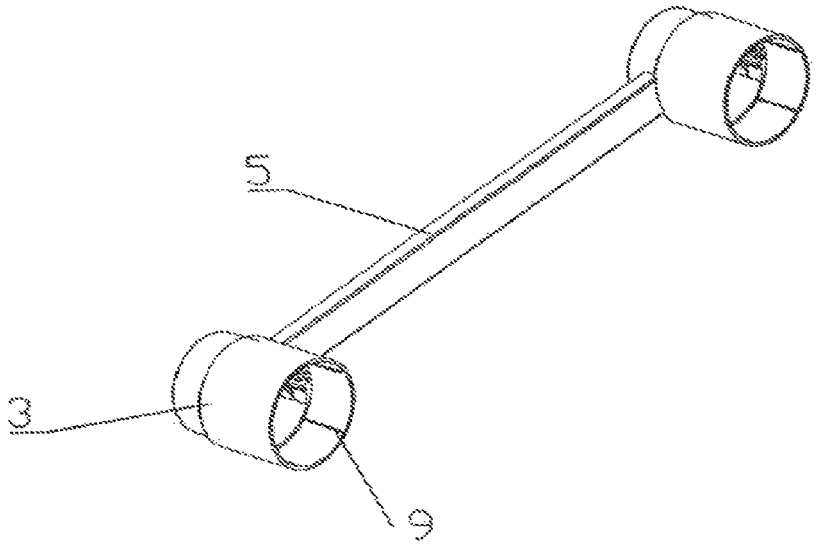
FIG. 3 is a perspective view of a structure, which is capable of being used in the curved LED tubular lamp of the embodiment 1, integrated as a whole by the first front supporter and the lamp caps of the embodiment 1 of this invention.

As shown in FIG. 3, certain ribs 9 are formed on the inner side of the casing 3A of each of the lamp caps 3 to provide a glue with an uniform thickness when the lamp caps 3 are capped on the terminals of the straight tubes 11A or 11B through the casing 3A, and the glue with an uniform thickness can avoid the presence of inconsistent slits caused by the gravity during aging period.

In other embodiments, as shown in FIG. 4, the lamp caps 3 and the first front supporter 5 are assembled as a whole, wherein the lamp caps 3 comprises a first lamp cap 3' with a first lamp casing 3A' and a first lamp cover 3B', and a second lamp cap 3" with a second lamp casing 3A" and a second lamp cover 3B". The first front supporter 5 is set forth between the first lamp cover 3B' and the second lamp cover 3B". The first lamp casing 3A' and the second lamp casing 3A" are separated from the first lamp cover 3B' and the second lamp cover 3B" on the first front supporter 5 before being assembled, and the conductive connector 6 is encapsulated inside the first front supporter 5. Two ends of the conductive connector 6 are extended outside the first front supporter 5. The power module 24 and a capacitor 25 are separately welded to two ends of the conductive connector 6 first, and respectively inserted into the first lamp casing 3A' and the second lamp casing 3A", then the first lamp casing 3A' with the power module 24 inside and the second lamp casing 3A" with the capacitor 25 inside are respectively fasten to the first lamp cover 3B' and the second lamp cover 3B" on the first front supporter 5 to be assembled as a whole. A plurality of ribs can be formed on the inner sides of the first lamp cover 3B and the second lamp cover 3B" as shown in FIG. 3, and details of ribs will not be discussed here. As described formerly, the capacitor 25 in FIG. 4 could be replaced by another driving circuit 4 for preventing overheat.

Figure 5:
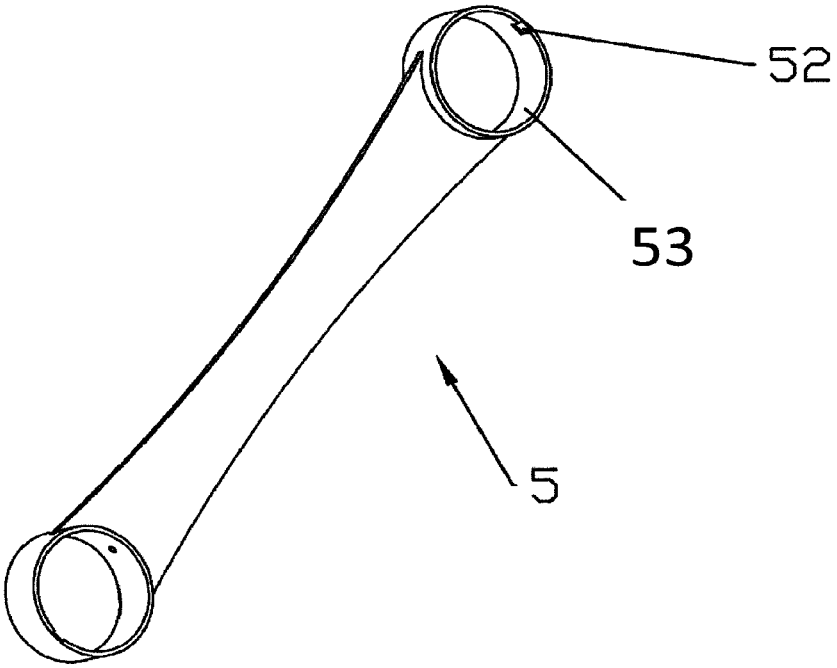
FIG. 5 is a perspective view of a front supporter which is capable of being applied in the structure as illustrated in FIG. 4.
Figure 6:
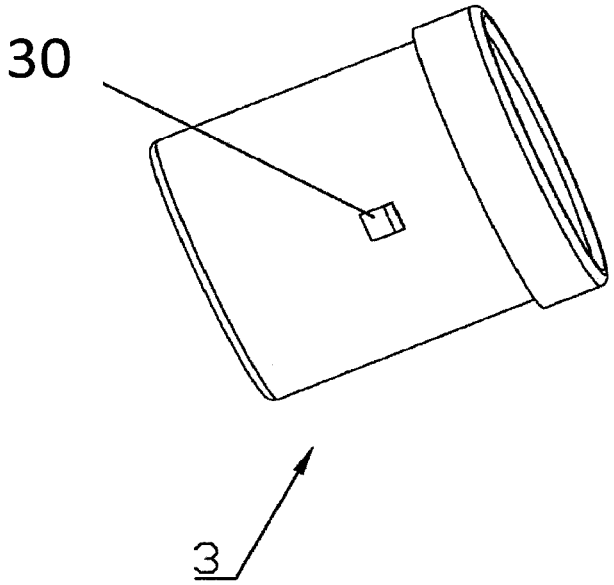
FIG. 6 is a perspective view of a lamp cap which can be assembled as whole with the first front supporter as illustrated in FIG. 5.

Furthermore, among other embodiments whose first front supporter 5 and the lamp caps 3 are assembled as a whole, as shown in FIGS. 5-6, the first front supporter 5 further comprises two separated collars 53 corresponding to those two lamp caps 3, wherein each lamp cap 3 and each collar 53 can be assembled by means of a positioning trench 52 formed on the inside of each collar 53 and a positioning protrusion 30.

Figure 7:
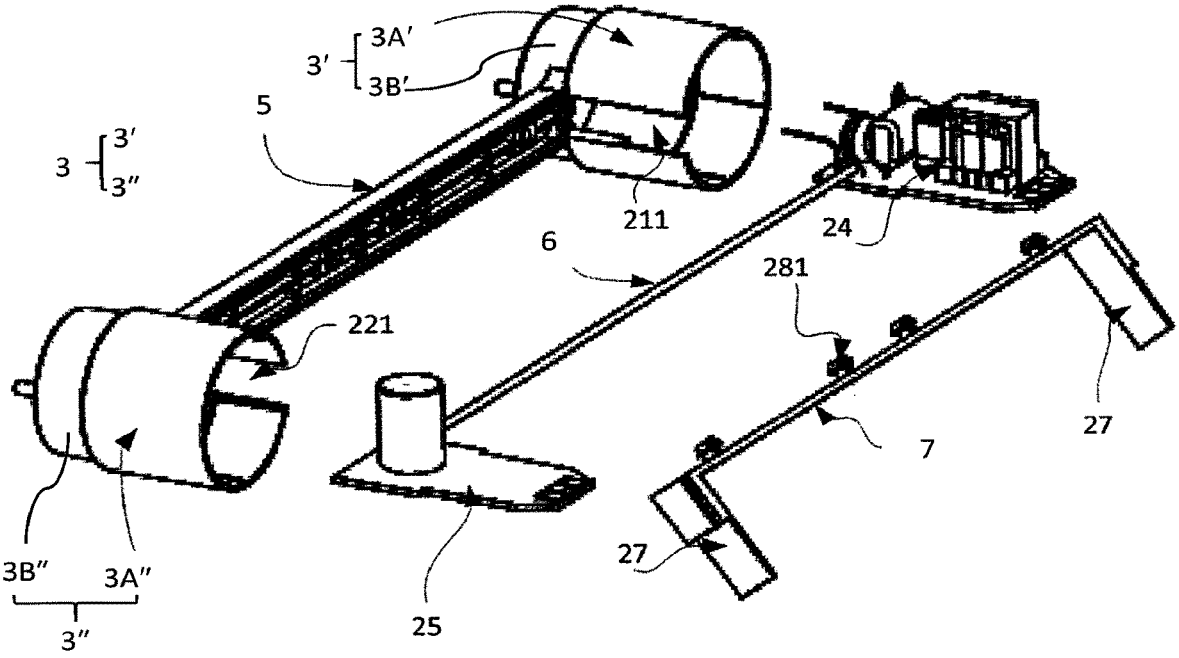
FIG. 7 is an exploded view of a structure integrated as a whole by the first front supporter and the lamp caps.

As mentioned above, the lamp caps 3 and the first front supporter 5 can also be integrated as a whole. FIG. 7 illustrates another embodiment whose lamp caps 3 and the first front supporter 5 are integrated as a whole, wherein the lamp caps 3 comprises a first lamp cap 3' with a first lamp casing 3A' and a first lamp cover 3B', and a second lamp cap 3" with a second lamp casing 3A" and a second lamp cover 3B", and the first front supporter 5 is set forth between the first lamp cover 3B' and the second lamp cover 3B" Each of front terminals of the first lamp cover 3B' and the second lamp cover 3B" comprises a pin for plugging on lamp bases (not shown) to interconnect to a power source, and the rear terminal of the first lamp casing 3A' is capped in or on the terminal (not labeled) of the straight tube 11A, and the rear terminal of the second lamp casing 3A" is capped in or on the end (not labeled) of the straight tube 11B. As shown in FIG. 7, the power module comprises the power module 24 encapsulated in the first lamp cap 3', and the capacitor 25 encapsulated in the second lamp cap 3", wherein the power module 24 and the capacitor 25 are interconnected by a conductive connector 6. The conductive connector 6 may be shield by the first front supporter 5 to avoid electric shock caused by the exposure. Furthermore, grooves 211 and 221 may be respectively formed on the first lamp casing 3A' and the second lamp casing 3A" to facilitate the installation of the power modules 24 and the capacitor 25, wherein grooves 211 and 221 have openings facing the terminals of the straight tubes 11A and 11B. The power module 24 and the capacitor 25 interconnected by the conductive connector 6 are installed to the first lamp cap 3' and the second lamp cap 3" through the aid of grooves 211 and 221, and the conductive connector 6 may be pulled into the grooves 211 and 221 through the openings thereof. By means of this kind of design, the conductive connector 6 can be moved together with the power module 24 and the capacitor 25, and interconnected with the first power module 24 and the capacitor 25 before installation, which can facilitate the installation of power modules.

As shown in FIG. 7, two tenons 27 may be disposed on grooves 211 and 221 respectively to avoid the exposure of the conductive connector 6, the power module 24 and the capacitor 25, wherein a second front supporter 7 may be formed between the two tenons 27, and the conductive connector 6 may be sandwiched between the first front supporter 5 and the second front supporter 7. The tenons 27 are used to block the grooves 211 and 221, and integrated or assembled as a whole with the second front supporter 7 to form a curved structure. The first front supporter 5 and the second front supporter 7 are separable joined. Preferably, the first front supporter 5 and the second front supporter 7 are joined by the plug-in mechanism. As shown in FIG. 7, the first front supporter 5 and the second front supporter 7 are joined by plugging each of the protrusions 281 formed on the second front supporter 7 into each of the sockets (not labeled) formed on the longitudinal axis of the first front supporter 5. The protrusions 281 can also be formed on the first front supporter 5, and the sockets can also be formed on the second front supporter 7. As shown in FIG. 7, the lamp cap 3 and the first front supporter 5 may be integrated as a whole, which can not only stabilize the structure of the curved LED tubular lamp, but also simplify the manufacturing processes, facilitate assembly and reduce the manufacturing cost.

Figure 8:
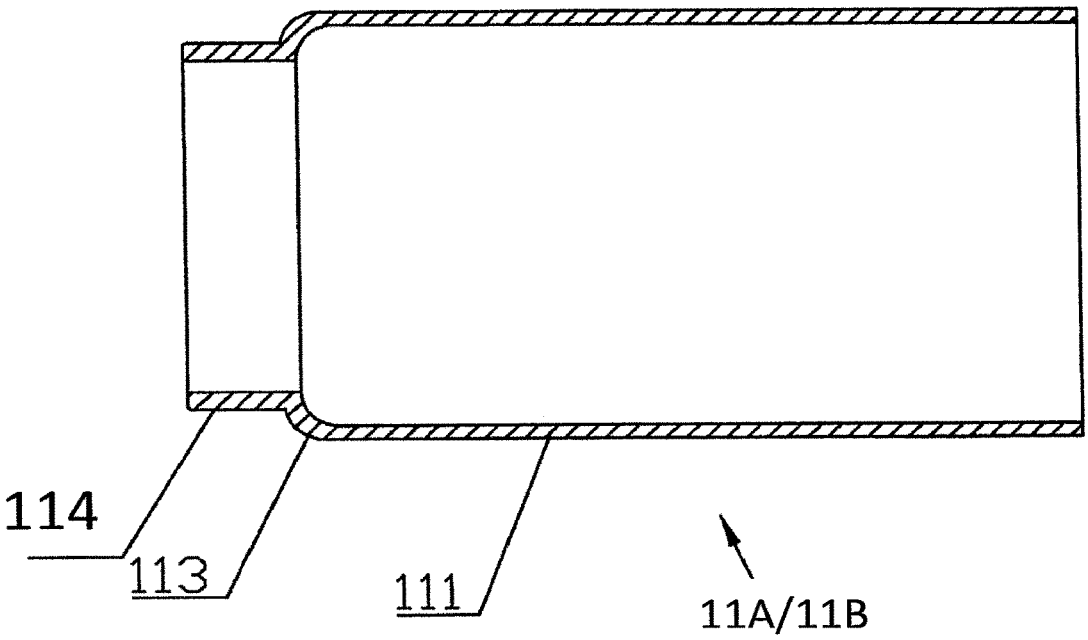
FIG. 8 is a side view of the end terminal of a straight tube of the curved lamp of the embodiment 1 of this invention.

Furthermore, as shown in FIG. 8, each of straight tubes 11A and 11B comprises a tube body 111 with at least one terminal 114 having an outside diameter smaller than that of the tube body 111 for installing the lamp cap 3. Preferably, the outer diameter of the lamp cap 3 gradually decreasing to approach or even equal to the outer diameter of the tube body 111 can ensure the packing materials to not only contact to the lamp caps 3 but also the straight tubes 11A and 11B to avoid broken caused by the stress concentrated on the lamp caps 3 and the terminals 114. Accordingly, curved LED tubular lamps with high yield rate and attractive appearance can be generated. Moreover, an arc angle part 113 with a curve surface can be further provided to locate between the tube body 111 and the terminal 114, and the straight tubes 11A and 11B can be further covered by a transparent film (not shown) to secure the straight tubes 11A and 11B not be broken into pieces when struck or fell down. A transparent film with different transmittance can be chosen to provide a curved LED tubular lamp with desired illumination. In addition, an insulating glue (not shown) can be coated on the LED light board 2 to avoid electronic shock when the lamp tube 1 is broken.

Figure 9:
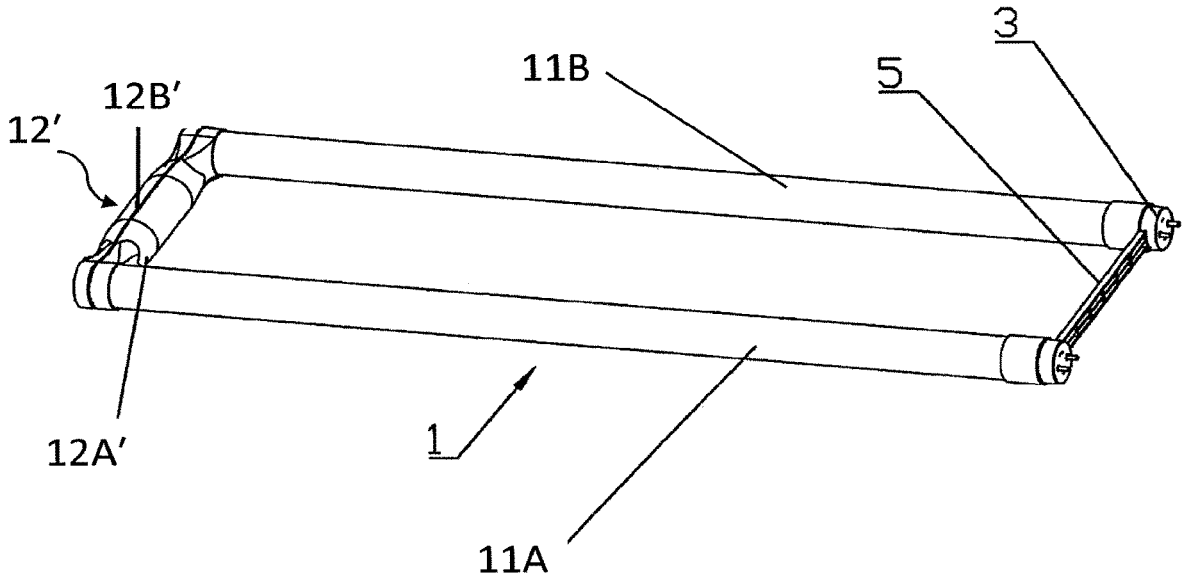
FIG. 9 is a perspective view of a curved LED tubular lamp of the embodiment 2 of this invention.
Figure 10:
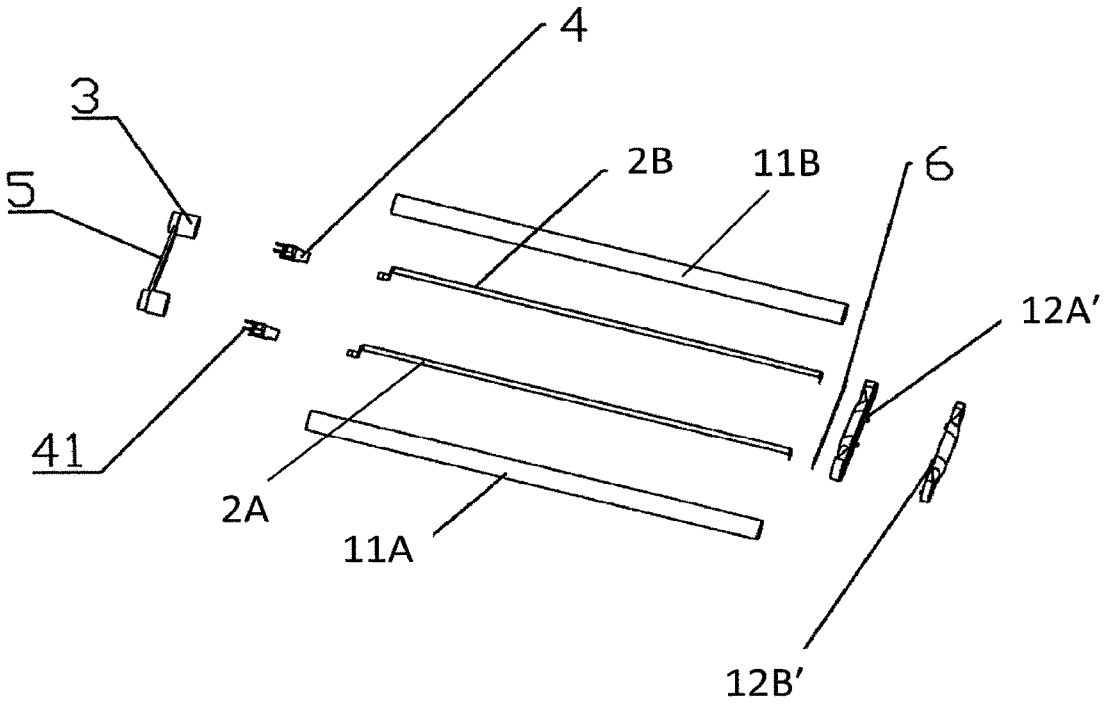
FIG. 10 is an exploded view of the curved LED tubular lamp as illustrated in FIG. 9.

Exemplary Embodiment 2:

As illustrated in FIGS. 9-10, the curved LED tubular lamp of this embodiment is similar to the curved lamp of embodiment 1 mentioned above, which comprises a lamp tube 1, a LED light board 2, lamp caps 3 and driving circuits 4.

However, the lamp tube 1 of this embodiment is assembled as a whole by two straight tubes 11A and 11B, and a rear supporter 12' therebetween, wherein the rear supporter 12' is made of a plastic with good transmittance. As for the lamp caps 3, they can be integrated as a whole or assembled as a whole with the first front supporter 5 as mentioned above. However, the lamp caps 3 shown in FIG. 10 are integrated as a whole with the supporter 5, and the lamp caps 3 can also be assembled as a whole with the supporter 5 in the other embodiments.

As shown in FIGS. 9-10, the end of the LED light board 2 is electrically connected to the conductive connector 6 to interconnect the driving circuits on two sides of the LED light board 2, wherein a wire or a LED light board can be selected as the conductive connector 6. Furthermore, the rear supporter 12' comprises a first rear supporter 12A' and a second rear supporter 12B', and the normal lines to the first rear supporter 12A' and the second rear supporter 12B' are parallel to the longitudinal axes of the straight tubes 11A and 11B. The conductive connector 6 is sandwiched and hided between the first rear supporter 12A' and the second rear supporter 12B' to avoid electronic shock caused by the exposure of the conductive connector 6. The conductive connector 6 can also be placed between the driving circuits 4 as mentioned in embodiment 1, and the rear supporter 12' is used to join the straight tubes 11A and 11B.

Figure 11:
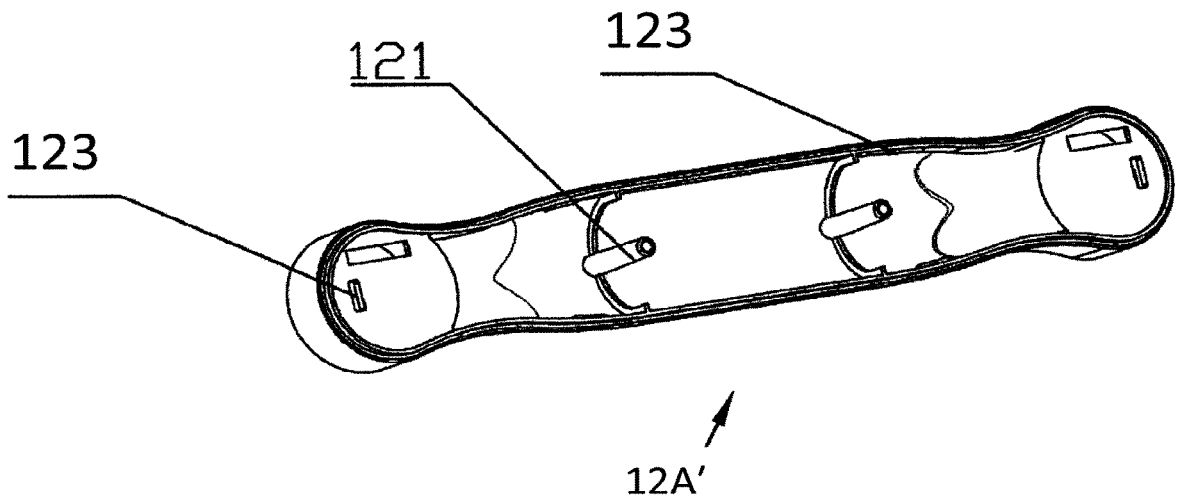
FIG. 11 is a perspective view of the first rear supporter which is capable of being applied in the curved LED tubular lamp of the embodiment 2 of this invention.
Figure 12:
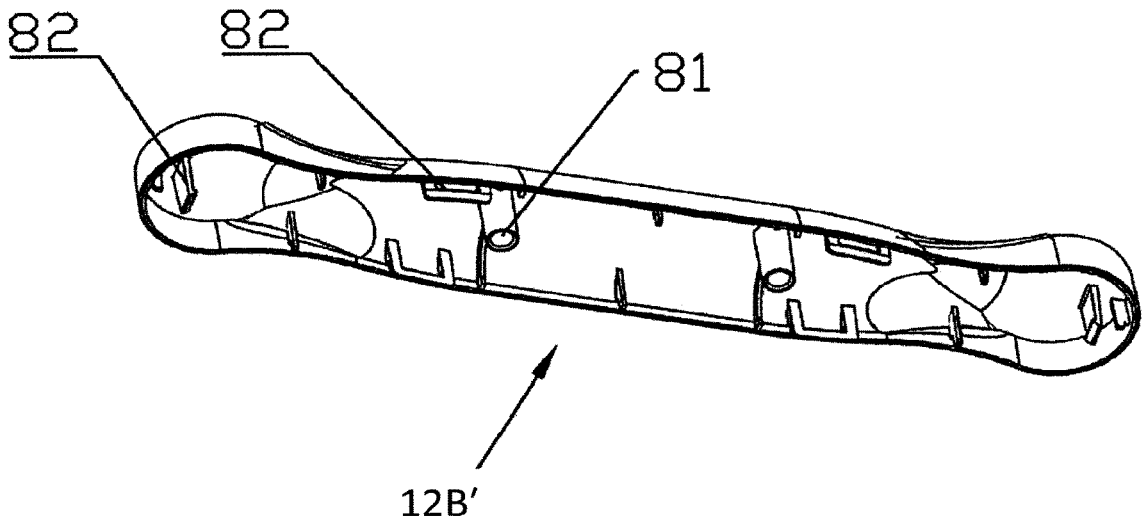
FIG. 12 is a perspective view of the second rear supporter corresponding to the first rear supporter as illustrated in FIG. 11.

Preferably, the conductive connector 6 is a flexible printed circuit board (FPC) joined with the LED light board 2 by welding. When a LED light board is selected as the connector 6 to generate a curved LED tubular lamp without a dark zone, a FPC with a plurality of LEDs formed thereon is preferable. Preferably, the first light bar 2A, the second light bar 2B and the connector 6 are flexible boards with a plurality of LEDs formed thereon. In order to secure the FPC, the first rear supporter 12A' and the second rear supporter 12B' are designed as illustrated in FIGS. 11-12. The first rear supporter 12A' comprises two first positioning pillars 121, and the second rear supporter 12B' comprises two second positioning pillars 81 corresponding to each of the first positioning pillars 121. The FPC comprises two positioning holes (not shown) corresponding to each of the positioning pillars 121, and the FPC can be well positioned by inserting the pillars 121 into the corresponding positioning holes (not shown), and the second rear supporter 12B' is assembled as a rear supporter 12' with the first rear supporter 12A' by capping the second positioning pillars 81 on the first positioning pillars 121. The positioning pillars may be not only column shape but also protrusion or cone shape.

Besides, the assembly of the first rear supporter 12A' and the second rear supporter 12B' can be fastened by the hooks 123 formed on two opposite sides and edge of the first rear supporter 12A' and the buckles 82 corresponding to the hooks 123 formed on the second rear supporter 12B'.

Furthermore, the first rear supporter 12A' and the second rear supporter 12B' can be made of transparent materials to make the light can also be transmitted out of the rear supporter 12' when the conductive connector 6 is a FPC with LEDs formed thereon.

Figure 13:
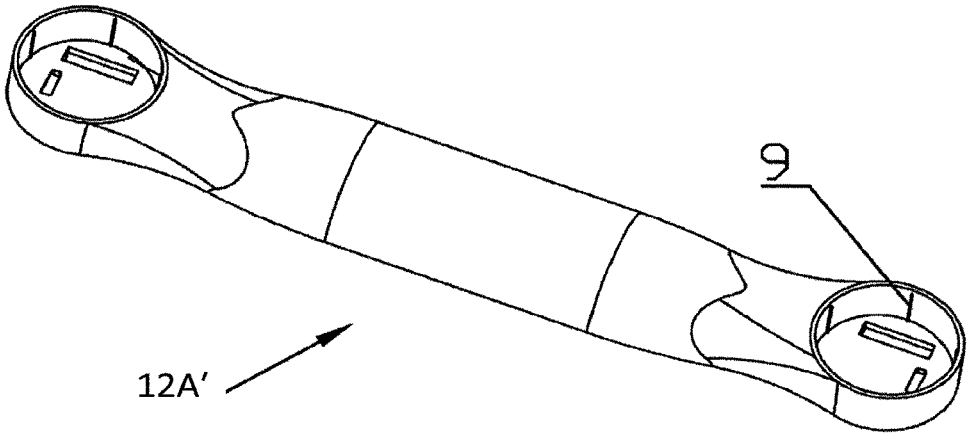
FIG. 13 is a perspective view of the first rear supporter viewed in another angle which is capable of being applied in the curved LED tubular lamp of the embodiment 2 of this invention.

Moreover, as shown in FIG. 13, the inner of the first rear supporter 12A' can further comprise certain ribs 9 as those formed on the inner of the lamp caps 3 shown in FIG. 3 to provide a glue with an uniform thickness when the first rear supporter 12A' is joined with the straight tubes 11A or 11B to avoid the presence of inconsistent slits caused by the gravity during aging period.

Figure 14:
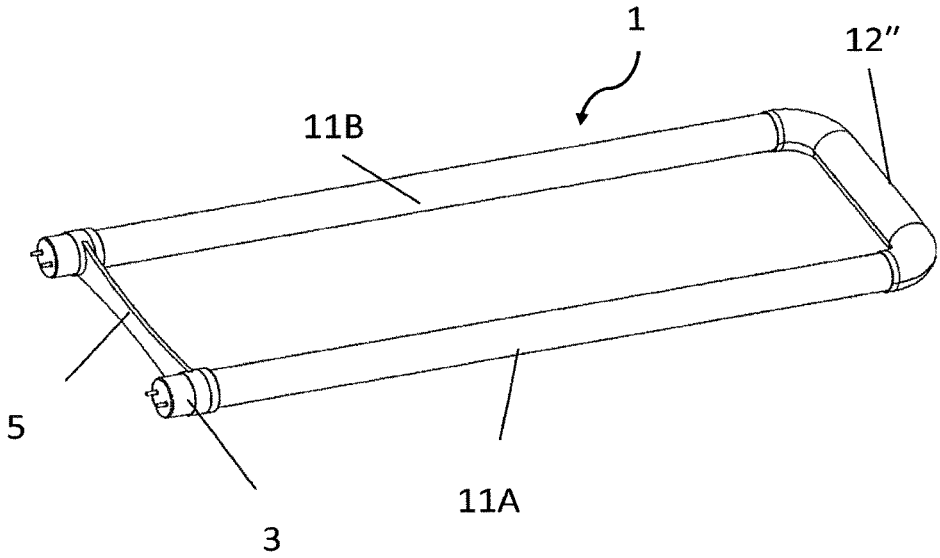
FIG. 14 is a perspective view of a curved LED tubular lamp of the embodiment 3 of this invention.
Figure 15:
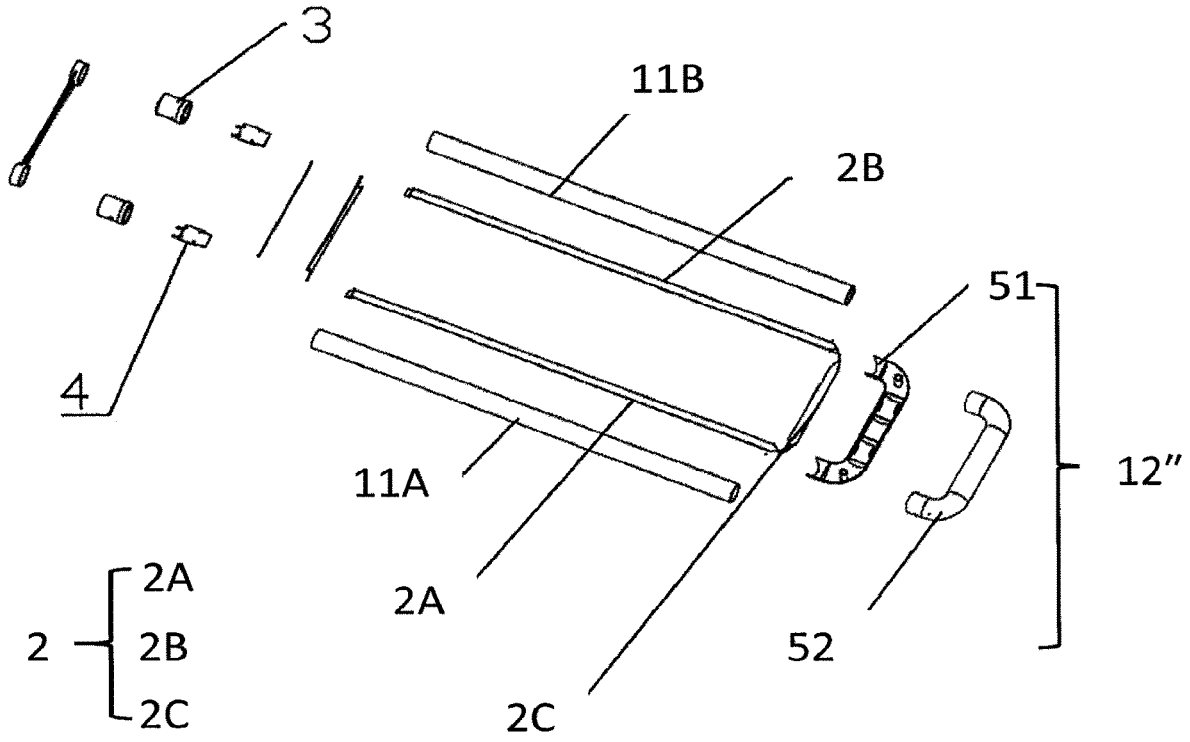
FIG. 15 is an exploded view of the curved LED tubular lamp as illustrated in FIG. 14.

Exemplary Embodiment 3:

As illustrated in FIGS. 14-15, the curved LED tubular lamp of this embodiment is similar to the curved lamp of embodiment 2 mentioned above, which comprises a lamp tube 1, a LED light board 2, lamp caps 3 and driving circuits 4. However, the lamp tube 1 of this embodiment is assembled as a whole by two straight tubes 11A and 11B, and a rear supporter 12" therebetween, wherein the rear supporter 12" may be made of a plastic with good transmittance and is not formed by integrating the straight tubes 11A and 11B as a whole. As for the lamp caps 3, they can be integrated as a whole or assembled as a whole with the first front supporter 5 as mentioned above. However, the lamp caps 3 shown in FIG. 14-15 are assembled as a whole with the supporter 5, and the lamp caps 3 can also be integrated as a whole with the supporter 5 in the other embodiments.

Figure 17:
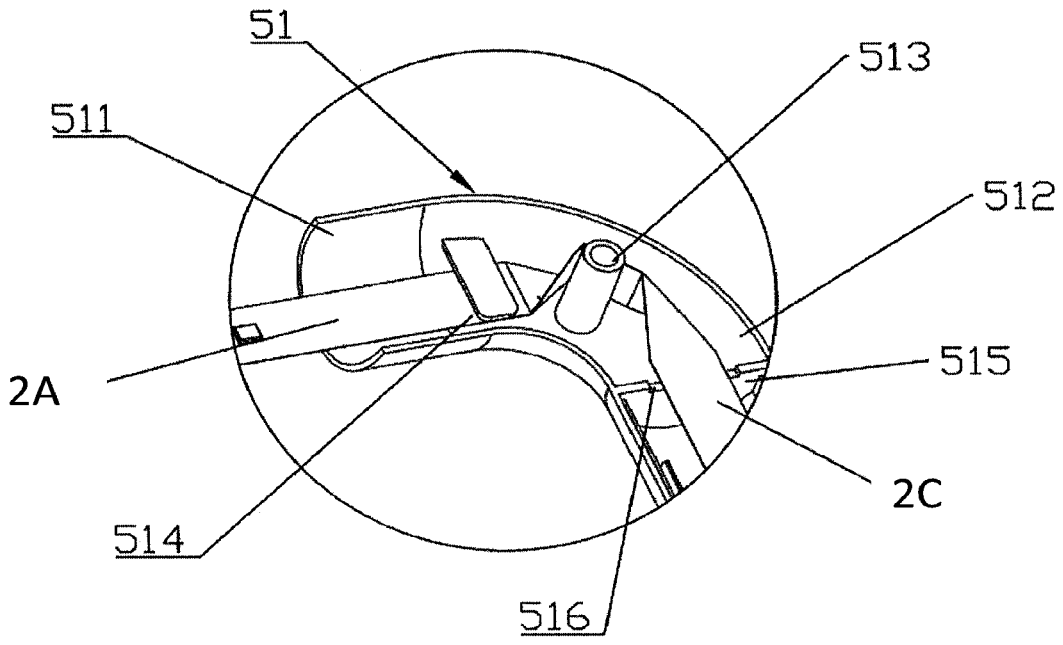
FIG. 17 is an enlarged perspective view of the first curved part of the curved LED tubular lamp as illustrated in FIG. 14.
Figure 18:
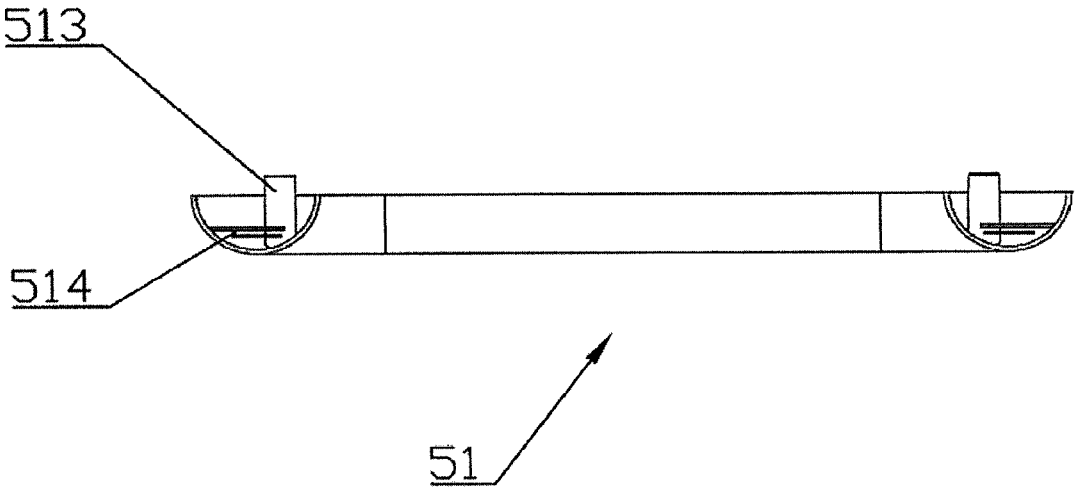
FIG. 18 is a front view of the first curved part of the curved LED tubular lamp as illustrated in FIG. 14.

As shown in FIGS. 15 and 17, the rear supporter 12" comprises a first curved part 51 and a second curved part 52, and the normal lines to the first curved part 51 and the second curved part 52 are perpendicular to the longitudinal axes of the straight tubes 11A and 11B. The first curved part 51 comprises a pair of first installing part 511 for respectively joining one terminal of the straight tube 11A, 11B; a first connecting part 512 extending straight between the two first installing parts 511, and a pair of first transition part 518 formed between the first connecting part 512 and the first installing parts 511 and have a curved-shape, wherein at least one positioning pillar(s) 513 may be formed in the first transition parts 518. The LED light board 2 may be a FPC with a plurality of LED formed thereon. As shown in FIG. 15, the LED light board 2 comprises a first light bar 2A installed primarily in the first straight tube 11A, a second light bar 2B installed primarily in the second straight tube 11B and a middle connecting segment 2C interconnected therebetween and installed in the rear supporter 12". Preferably, the first light bar 2A, the second light bar 2B and the middle connecting segment 2C are flexible boards with a plurality of LEDs formed thereon to generate a curved LED tubular without a dark zone. The LED light board 2 can be well assembled and positioned by bending 90 degrees through the positioning pillars 513.

As shown in FIGS. 16-20, two positioning protrusions 514 horizontally spaced with each other are formed within the first transition parts 518. The space between those two positioning protrusions 514 corresponds to the thickness of the LED light board 2 to ensure the LED light board 2 be tightly clamped between those two positioning protrusions 514, which can not only position the LED light board 2 but also avoid twisting of the LED light board 2 due to bending 90 degrees through the positioning pillars 513. Furthermore, a plurality of first rib boards 515 are formed on the first connecting part 512 and spaced from each other. The first rib boards 515 further comprise positioning grooves 516 corresponding to the LED light board 2 to enhance the strength of the first curved part 51, and guide and fasten the middle connecting segment 2C of the LED light board 2.

Figure 19:
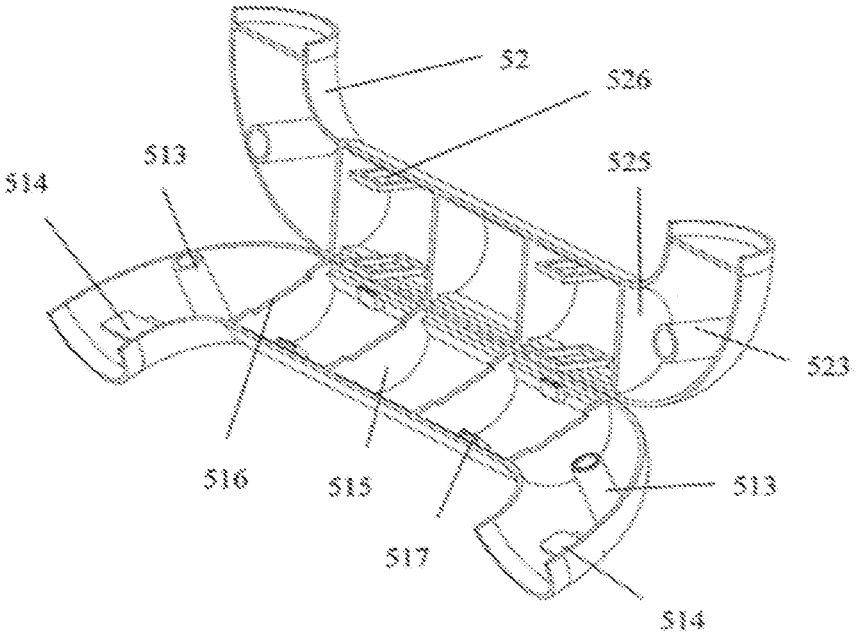
FIG. 19 is a perspective view of the first curved part and the second curved of the Curved LED tubular lamp as illustrated in FIG. 14 before being assembled as a whole.
Figure 21:
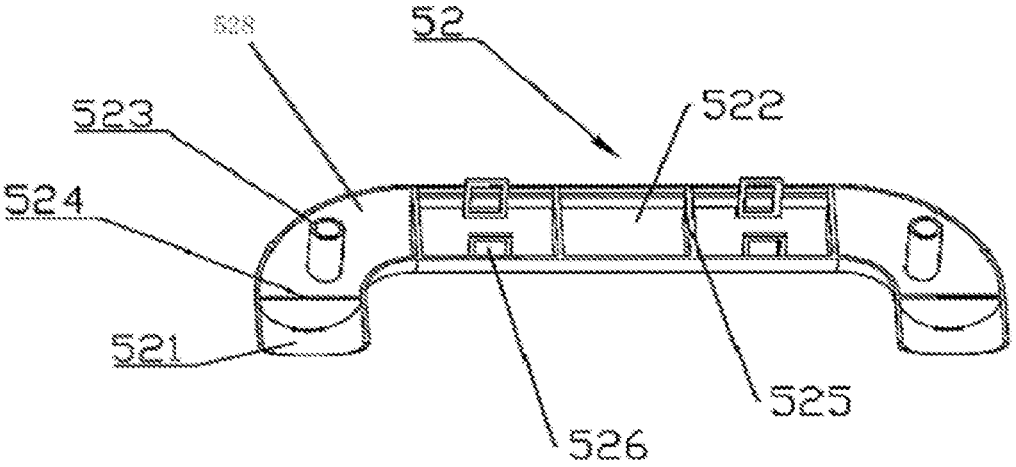
FIG. 21 is a perspective view of the second curved part as illustrated in FIG. 14 after removing the second curved part.

As shown in FIGS. 19 and 21, the second curved part 52 comprises a pair of second installing parts 521 for joining one terminal of the straight tube 11B; a second connecting part 522 extending straight between the two second installing parts 521, and a pair of second transition part 528 formed between the second installing parts 521 and the second connecting part 522. Wherein at least one positioning cap(s) 523 corresponding to the positioning pillars 513 may be formed in the second transition parts 528. The second curved part 52 is positioned by capping the positioning caps 523 to the positioning pillars 513. Furthermore, a plurality of second rib boards 525 are formed on the second connecting part 522 and spaced from each other. The second rib boards 525 corresponding to the first rib boards 515 and fix/press the middle connecting segment 2C of the LED light board 2. The second rib boards 525 can enhance the strength of the second curved part 52. The middle connecting segment 2C of the LED light board 2 can be tightly clamped between the first rib board 515 and the second rib board 525 to ensure the position of the LED light board 2. The installing part (not labeled) of the rear supporter 12" comprises a first installing part 511 and a second installing part 521, and the connecting part (not labeled) of the rear supporter 12" comprises a first connecting part 512 and a second connecting part 522, and a curved part (not labeled) with positioning pillars 513/positioning caps 523 may be located between the installing part (not labeled) and the connecting part (not labeled).

Figure 16:
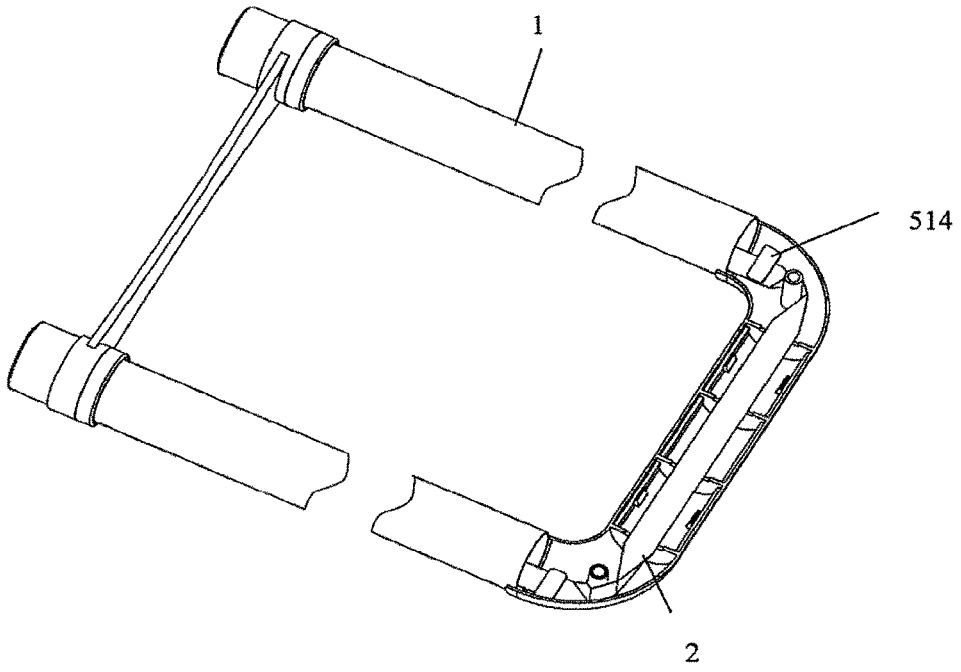
FIG. 16 is a partial perspective view of the curved LED tubular lamp as illustrated in FIG. 14 after removing the second curved part.

As shown in FIGS. 16-17, the LED light board 2 in the installing part (not labeled) and the connecting part (not labeled) is horizontally extended along the same longitudinal axes of the first, second light bars 2A, 2B, and the LED light board 2 in the curved is vertically extended after fastened by the rear supporter 12". Owing to the curved part is shorter than the installing part and the connecting part, so the LED light board 2 are almost horizontally extended. Accordingly, the illumination uniformity of the curved LED tubular lamp can be highly improved.

Moreover, a position board (i.e. baffle board) 524 can further be formed on the second installing part 521 of the second curved part 52 to restrict the light tube 1 along a desired direction to facilitate following assembly.

Figure 20:
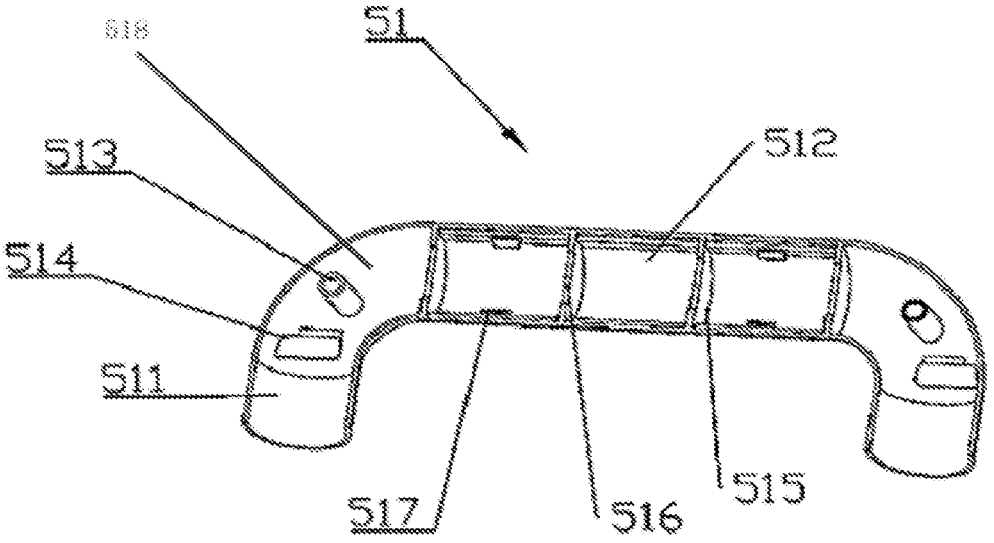
FIG. 20 is a perspective view of the first curved part as illustrated in FIG. 14 after removing the second curved part.

As shown in FIGS. 19-21, the assembly of the first curved part 51 and the second curved part 52 can be secure by further forming two additional hooks 517 on two opposite sides of the first connecting part 512 of the first curved part 51, and two additional buckles 526 corresponding to the hooks 517 formed on two opposite sides of the second connecting part 522 of the second curved part 52. The amount of hooks and buckles is not limited to two, it can also be one, three, or more.

Figure 22:
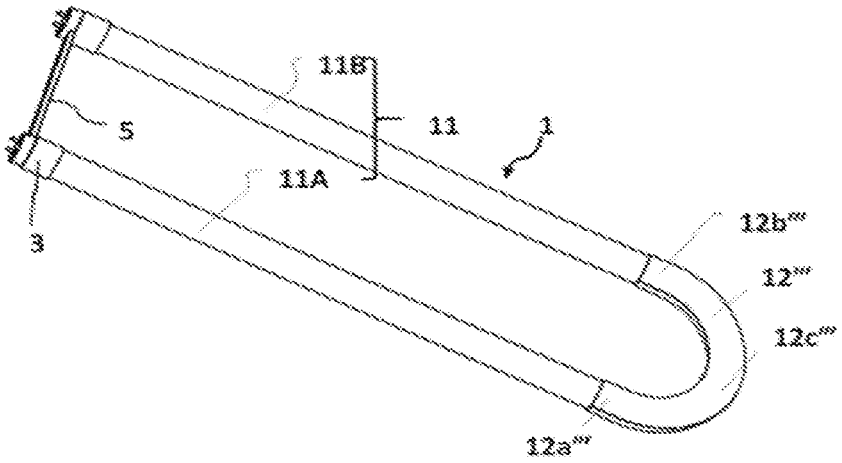
FIG. 22 is a perspective view of a curved LED tubular lamp of the embodiment 4 of this invention.
Figure 23:
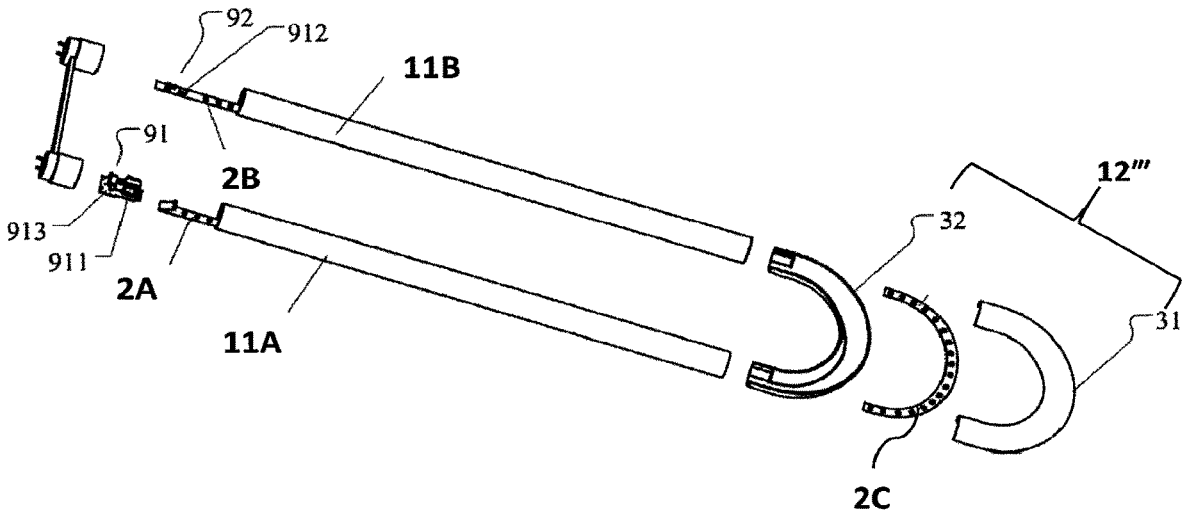
FIG. 23 is an exploded view of the curved LED tubular lamp as illustrated in FIG. 22.
Figure 24:
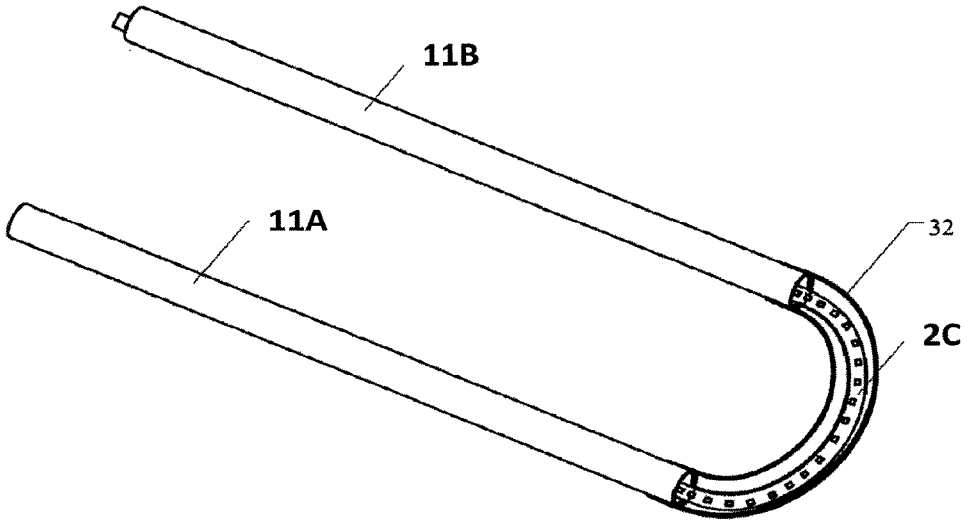
FIG. 24 is a partial perspective view of the curved LED tubular lamp as illustrated in FIG. 22 after removing the second curved upper unit

Exemplary Embodiment 4:

The curved LED tubular lamp of this embodiment is similar to the curved lamp of embodiment 3 mentioned above, which comprises a lamp tube 1, a LED light board 2, lamp caps 3 and a driving circuit 4. The difference is the rear supporter 12''' for joining the first straight tube 11A and the second straight tube 11B. As illustrated in FIGS. 22-24, the first straight tube 11A and the second straight tube 11B are assembled as a whole by the rear supporter 12''', and the first straight tube 11A and the second straight tube 11B are both made of a transparent material such as glass or plastic. The rear supporter 12''' is a hollow structure comprising a curved upper unit 31 and a curved lower unit 32, wherein the normal lines to the curved upper unit and the curved lower unit are perpendicular to the longitudinal axes of the first straight tube and the second straight tube, and the curved upper unit 31 is capped on the curved lower unit 32 to assemble the rear supporter 12'''. As the overall structure illustrated in FIG. 22, the rear supporter 12''' comprises two straight segments 12*a*'''', 12*b*''', and a curved part 12*c*''', wherein the end terminals of these two straight segments 12*a*''' and 12*b*''' are designed for the first straight tube 11A and the second straight tube 11B to insert therein and join therewith.

Figure 28:
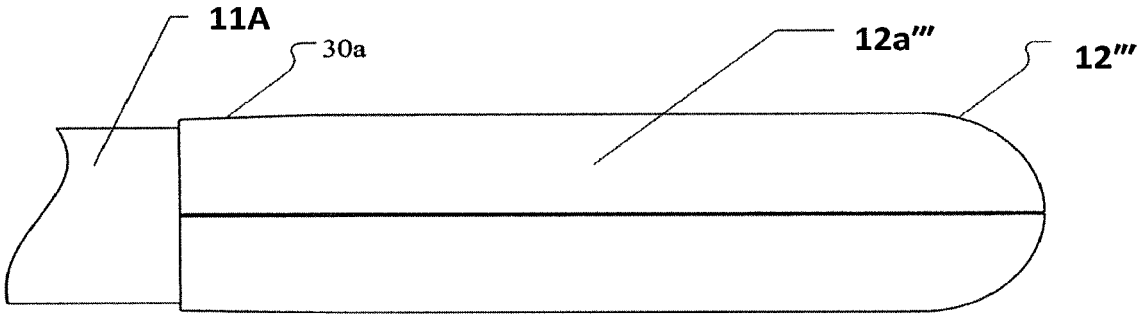
FIG. 28 is an enlarged partial perspective view of the first curved part of the curved LED tubular lamp as illustrated in FIG. 22.

As illustrated in FIG. 28, the outer diameter of the end terminal of the straight segment 12*a*''' increases with the distance away from the join part of the straight tube 11A and the straight segment 12*a*''' of the rear supporter 12''' to provide a natural and attractive visual appearance.

Figure 25:
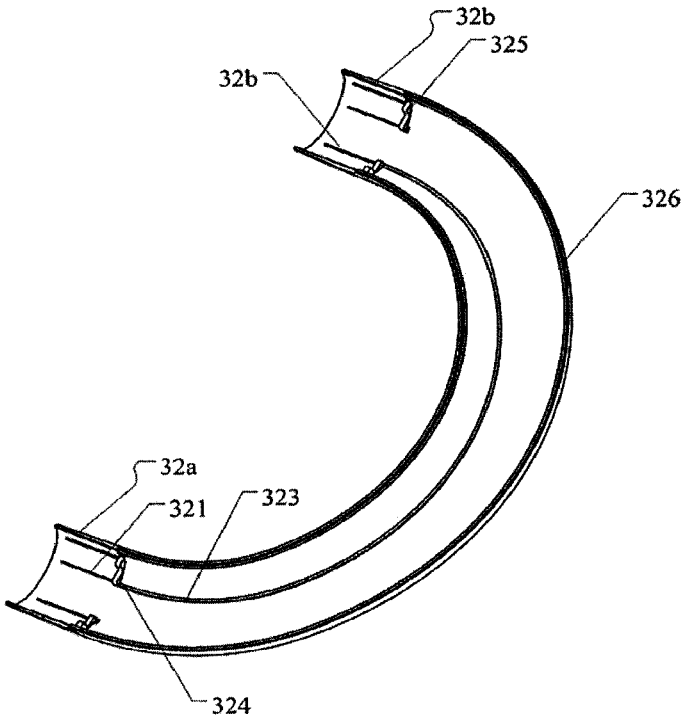
FIG. 25 is a perspective view of the curved lower unit as illustrated in FIG. 22.
Figure 26:
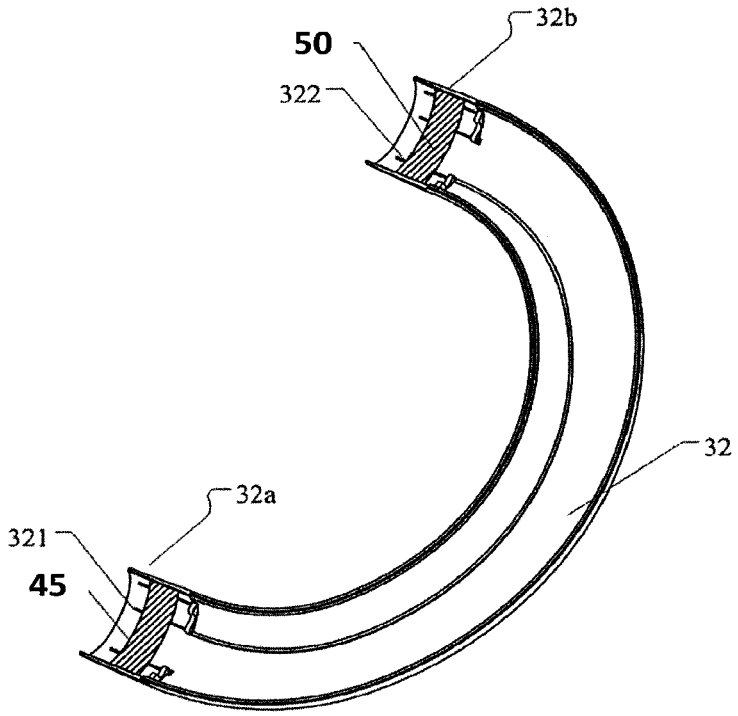
FIG. 26 is a plain view of the curved lower unit as illustrated in FIG. 25 after coating a glue thereon.
Figure 32:
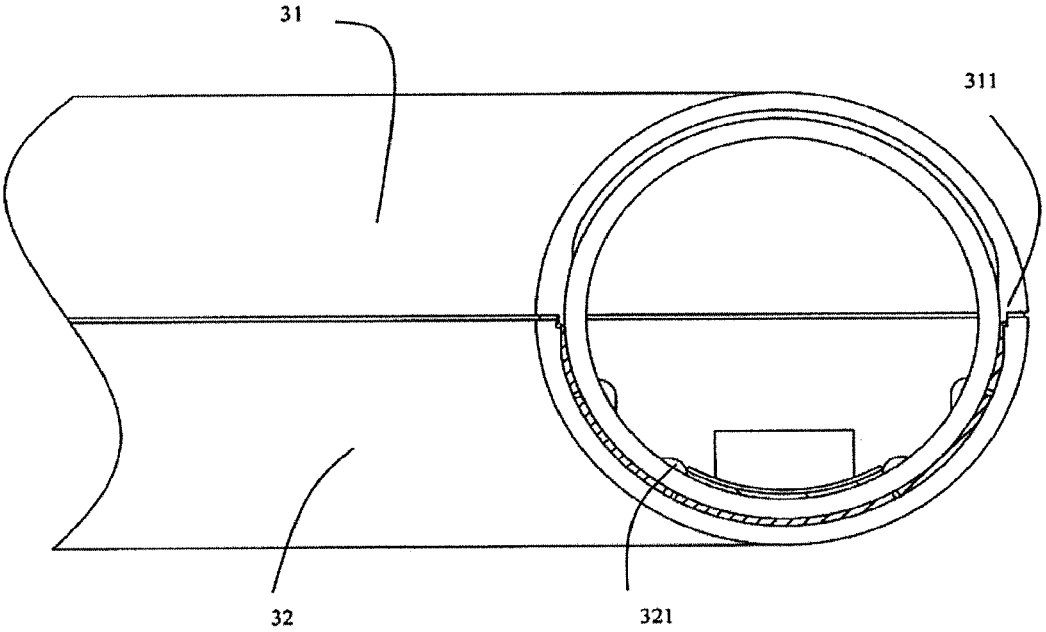
FIG. 32 is another partial cross-sectional view of the curved lamp as illustrated in FIG. 22.

As illustrated in FIGS. 25, 26 and 32, the first end 32*a* of the curved lower unit 32 comprises at least one first protruding rib 321 protruded from the inner surface of the first end 32*a* and extended along the longitudinal axis of the first end 32*a* to support the first straight tube 11A by placing the end of the first straight tube 11A thereon and form a first glue-coating space (not labeled) to fasten the first straight tube 11A and the first end 32*a* of the curved lower unit 32 by coating first glue 45 therein. It is understood that sufficient first glue 45 can be coated onto the first glue-coating space between the outer surface of the first straight tube 11A and the first end 32*a* of the curved lower unit 32 to secure that the first straight tube 11A and the curved lower unit 32 can be tightly assembled. Further, the first protruding rib 321 protruded from the inner surface of the first end 32*a* and extended along the longitudinal axis of the first end 32*a* make it be easily manufactured and make the first straight tube 11A have longer contact area with the first glue 45 along the longitudinal axis thereof to secure that the curved lower unit 32 can be tightly assembled. Similarly, the second end 32*b* of the curved lower unit 32 comprises at least one second protruding rib 322 protruded from the inner surface of the second end 32*b* and extended along the longitudinal axis of the second end 32*b* to support the second straight tube 11B by placing the end of the second straight tube 11B thereon and form a second glue-coating space (not labeled) to fasten the second straight tube 11B and the second end 32*b* of the curved lower unit 32 by coating second glue 50 therein. It is also understood that sufficient second glue 50 can be coated onto the second glue-coating space between the outer surface of the second straight tube 11B and the second end 32*b* of the curved lower unit 32 to secure that the second straight tube 11B and the curved lower unit 32 can be tightly assembled. Further, the second protruding rib 322 protruded from the inner surface of the second end 32*b* and extended along the longitudinal axis of the second end 32*ab* make it be easily manufactured and make the second straight tube 11B have longer contact area with the second glue 50 along the longitudinal axis thereof to secure the curved lower unit 32 be tightly assembled.

Figure 30:
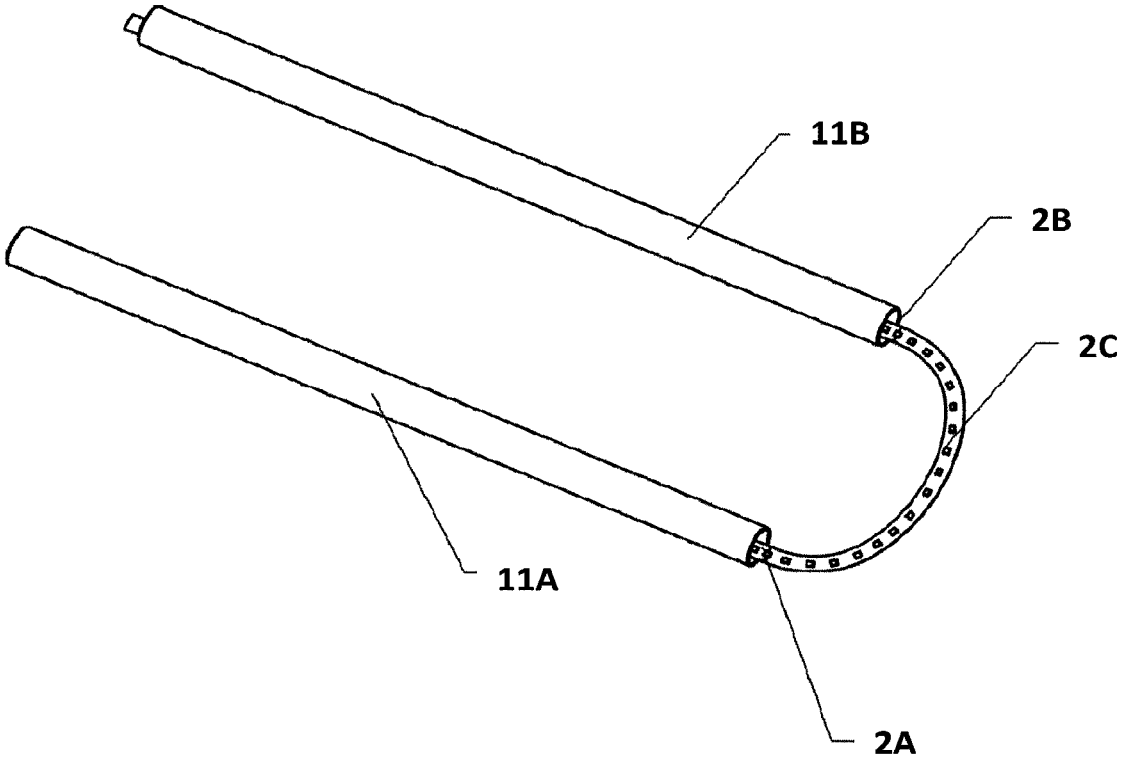
FIG. 30 is a perspective view of the curved LED tubular lamp of the embodiment 4 after removing the rear supporter.
Figure 31:
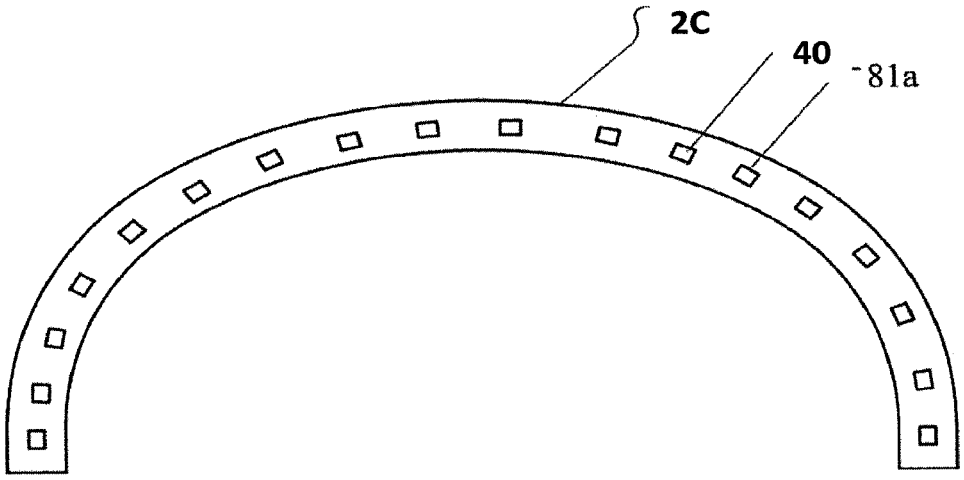
FIG. 31 is a plain view of the middle connecting segment of the curved LED tubular lamp as illustrated in FIG. 22.

As illustrated in FIGS. 30, 32, a first protrusion 311 is formed on the edge of the first end 31*a* of the curved upper unit 31 to stick on the outer surface of the first straight tube 11A and guide it along the longitudinal direction thereof. Also, as illustrated in FIG. 31, a second protrusion 312 is formed on the edge of the second end 31*b* of the curved upper unit 31 to stick on the outer surface of the second straight tube 11B and guide it along the longitudinal direction thereof. According to this present embodiment, the first protrusion 311 and the second protrusion 312 may be linked with each other by forming the first protrusion 311 and the second protrusion 312 protruded from the curved upper unit 31 and respectively extended along the same edge of the curved upper unit 31 from the first end and the second end of the curved upper unit 31. Accordingly, a smooth surface between two edges of the curved upper unit 31 is provided, and the luminous efficiency and uniformity of the curved LED tubular lamp can be enhanced. According to other embodiments of this invention, the curved upper unit 31 can comprises at least one first protrusion 311 and at least one second protrusion 312 formed on other places of the curved upper unit 31.

Figure 27:
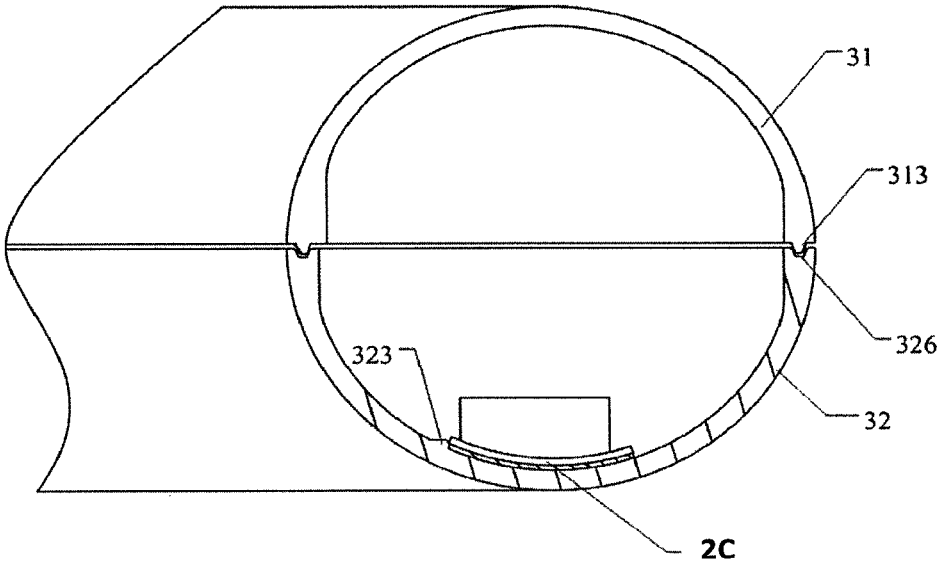
FIG. 27 is a partial cross-sectional view of the curved lamp as illustrated in FIG. 22.

As illustrated in FIGS. 25 and 27, the curved lower unit 32 comprises a curved ridgeline 323 extending along the longitudinal axis of the curved lower unit 32 to press against the side edge of the middle connecting segment 2C for guiding and positioning.

Figure 33:
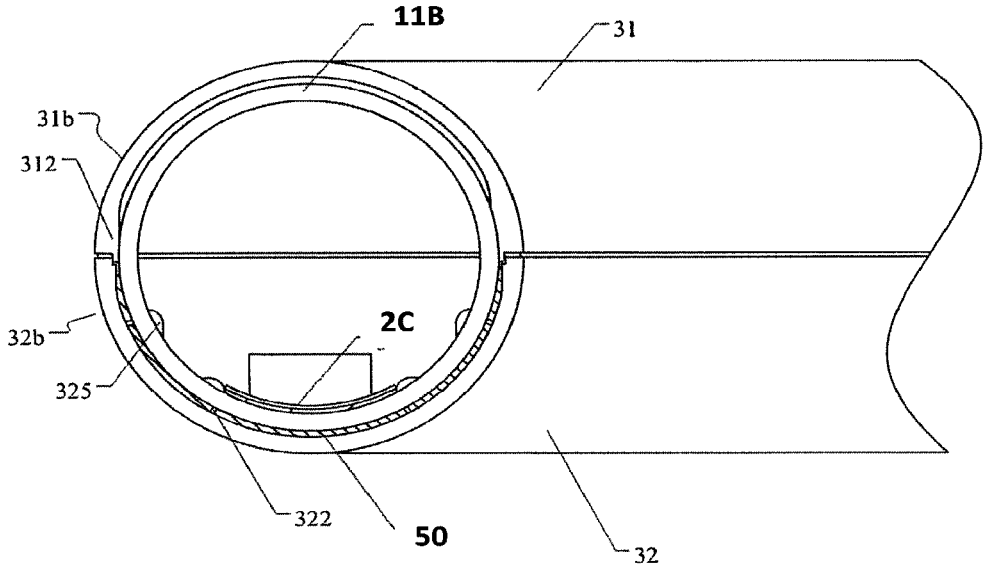
FIG. 33 is another partial cross-sectional view of the curved lamp of embodiment 4 of this invention viewed in another angle.

As illustrated in FIGS. 25 and 32, the first end 32*a* of the curved lower unit 32 further comprises two first baffle plates 324 spaced with each other for blocking/pressing against the end terminal of the first straight tube 11A to position the first straight tube 11A when installing. As illustrated in FIGS. 25 and 33, the second end 32*b* of the curved lower unit 32 further comprises two second baffle plates 325 spaced with each other for blocking/pressing against the end terminal of the second straight tube 11B to position the second straight tube 11B when installing.

As illustrated in FIGS. 23 and 25, the curved lower unit 32 further comprises a trench 326 on the surface contacting to the curved upper unit 31, wherein the trench 326 extends along the edge of the curved lower unit 32. The curved upper unit 31 further comprises a protruded edge 313 for inserting the trench 326, wherein the protruded edge 313 extends along the edge of the curved upper unit 31. By inserting the protruded edge 313 of the curved upper unit 31 into the trench 312 of the curved lower unit 32 to form the rear supporter 12''' can ensure that the curved upper unit 31 and the curved lower unit 32 can be tightly assembled and avoid light leakage.

As illustrated in FIGS. 23 and 30, the first light bar 2A is installed in the first straight tube 11A, the second light bar 2B is installed in the second straight tube 11B, and the middle connecting segment 2C with a plurality of LEDs formed thereon electrically connected to the first light bar 2A and the second light bar 2B is installed in the rear supporter 12'''. Preferably, the first light bar 2A, the second light bar 2B and the middle connecting segment 2C are flexible boards with a plurality of LEDs formed thereon to generate a curved LED tubular lamp without a dark zone. The first light bar 2A may extend from the straight tube 11A and is not restricted to being within the straight tube 11A; the second light bar 2B may be not restricted to being within the second straight tube 11B; the middle connecting segment 2C may be not restricted to being within the rear supporter 12'''.

Figure 29:
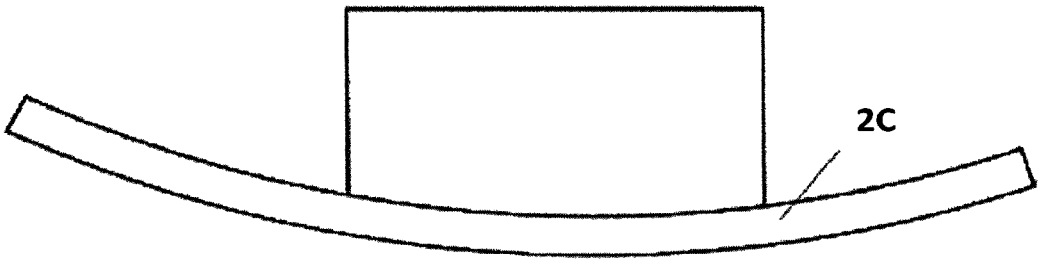
FIG. 29 is a cross-sectional view of the middle connecting segment of the curved LED tubular lamp as illustrated in FIG. 22.

The first light bar 2A, the middle connecting segment 2C and the second light bar 2B can be welded in series by extending the end terminal of the first light bar 2A into the rear supporter 12''', or extending the end terminal of the middle connecting segment 2C into the first straight tube 11A, or extending the end terminal of the second light bar 2B into the rear supporter 12''', or extending the end terminal of the middle connecting segment 2C into the second straight tube 11B. The lighting surface of the middle connecting segment 2C is installed by facing toward the curved upper unit 31, and at least the curved upper unit 31 of the rear supporter 12''' is made of a transparent material, so the whole curved LED tubular lamp can emit uniform light. As illustrated in FIGS. 24 and 29, the middle connecting segment 2C is curved and extends along the axis of the rear supporter 12''', so the lighting of the curved LED tubular lamp can be more uniform.

As illustrated in FIG. 25, the cross-sectional view of the rear supporter 12''' looks like a curve, and the cross-sectional view of the curved lower unit 32 also looks like a curve, which makes the middle connecting segment 2C be contacted with the curved lower unit 32 face-by-face. In addition, the LEDs 40 on the middle connecting segment 2C can be installed on the extending surface 81*a* of the middle connecting segment 2C to make the LEDs be arranged toward a desired angle to enhance the luminous uniformity of the rear supporter 12'''.

Furthermore, as illustrated in FIGS. 22 and 23, the lamp caps and the first front supporter 5 can be integrated as a whole or assembled as a whole as described in the embodiment 1. The driving circuits for driving the first light bar 2A, the second light bar 2B and the middle connecting segment 2C comprise a first driving circuit 91 and a second driving circuit 92. In order to tell the first driving circuit 91 from the second driving circuit 92, the first driving circuit 91 comprises a first power device 911 of this embodiment is formed on an individual circuit board 913 interconnected to the circuit formed thereon, and the second driving circuit 92 comprises a second power device 912 formed on the second light bar 2B and interconnected to the circuit on the second light bar 2B. The driving circuit 91 and the second driving circuit 92 of other embodiments of this invention can also be respectively formed on the first light bar 2A and the second light bar 2B or respectively formed on individual circuit boards.

Exemplary Embodiment 5:

The curved LED tubular lamp of this embodiment is similar to the curved lamps mentioned above, which is characterized by the LED light board installed in the first straight tube 11A, the second straight tube 11B and the curved part 13 is free from warpage and the luminous efficiency of the curved LED tubular lamp without a dark zone can be enhanced.

Figure 34:
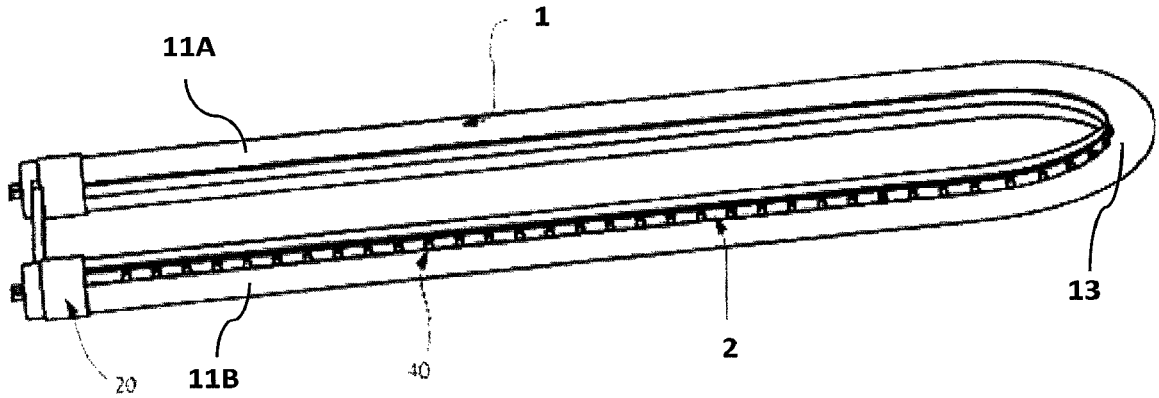
FIG. 34 is a perspective view of a curved LED tubular lamp of the embodiment 5 of this invention.

As illustrated in FIGS. 34 to 40, the curved LED tubular lamp comprises a lamp tube 1 having a first straight tube 11A, a second straight tube 11B parallel to the first straight tube 11A, and a curved part 13 connected to the first straight tube 11A and the second straight tube 11B. The curved part 13 can be the rear supporter 12 integrated as a whole with the first straight tube 11A and the second straight tube 11B as mentioned in the embodiment 1, or the rear supporters 12', 12'' or 12''' assembled as a whole with the first straight tube 11A and the second straight tub 11B as mentioned in embodiments 2, 3 and 4. The lamp tube 1 can be made of plastic or glass, and preferably glass to provide better heat dissipation. The shape of the cross-sectional area of the lamp tube 1 can be circle, square or other irregular shape, and preferable but not to limited to circle to facilitate the production of the lamp tube. Usually, the curved part 13 has a substantial semicircular structure with a radius angle of about 180 degree. The first straight tube 11A has a first inner wall 111 and an opposite first outer wall 112 along the longitudinal axis of the first straight tube 11A, and the second straight tube 11B has a second inner wall 121 and an opposite second outer wall 122 along the longitudinal axis of the second straight tube 11B, and the curved part 13 has a third inner wall 131 and an opposite third wall 132 along the axis of the curved part 13, wherein the first inner wall 111, the third inner wall 131 and the second inner wall 121 is defined as an inner area (not labeled), and the first outer wall 112, the third outer wall 132 and the second outer wall 122 is defined as an outer area (not labeled). As illustrated in FIG. 34, a part or whole of the surface of the LED light board 2 opposite to the LEDs is attached on the inner area (not labeled) of the lamp tube 1.

Figure 35:
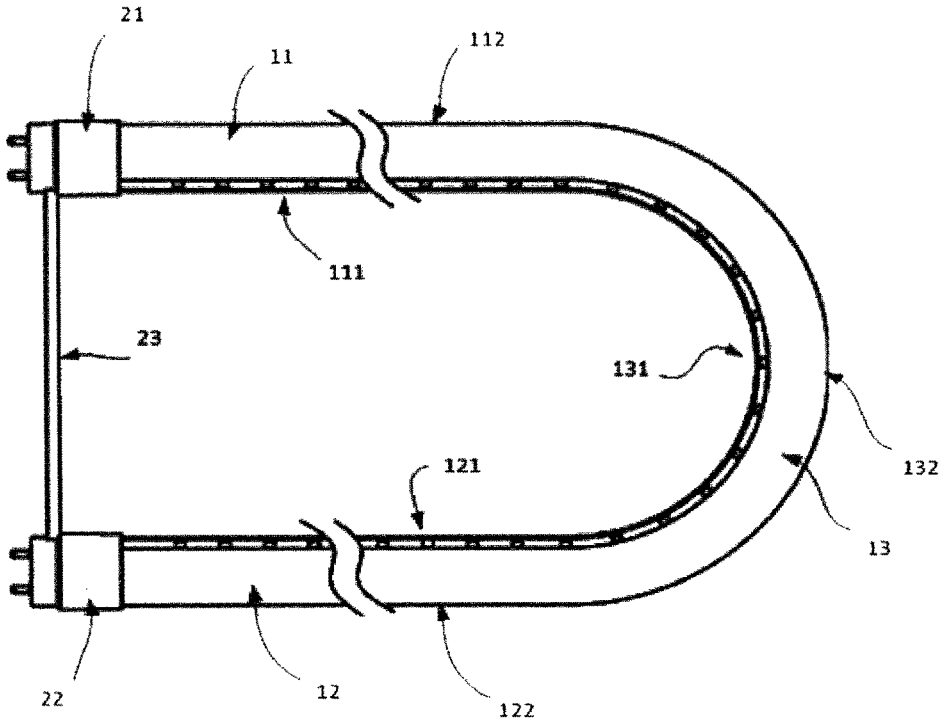
FIG. 35 is a plain view of the curved LED tubular lamp as illustrated in FIG. 34.
Figure 36:
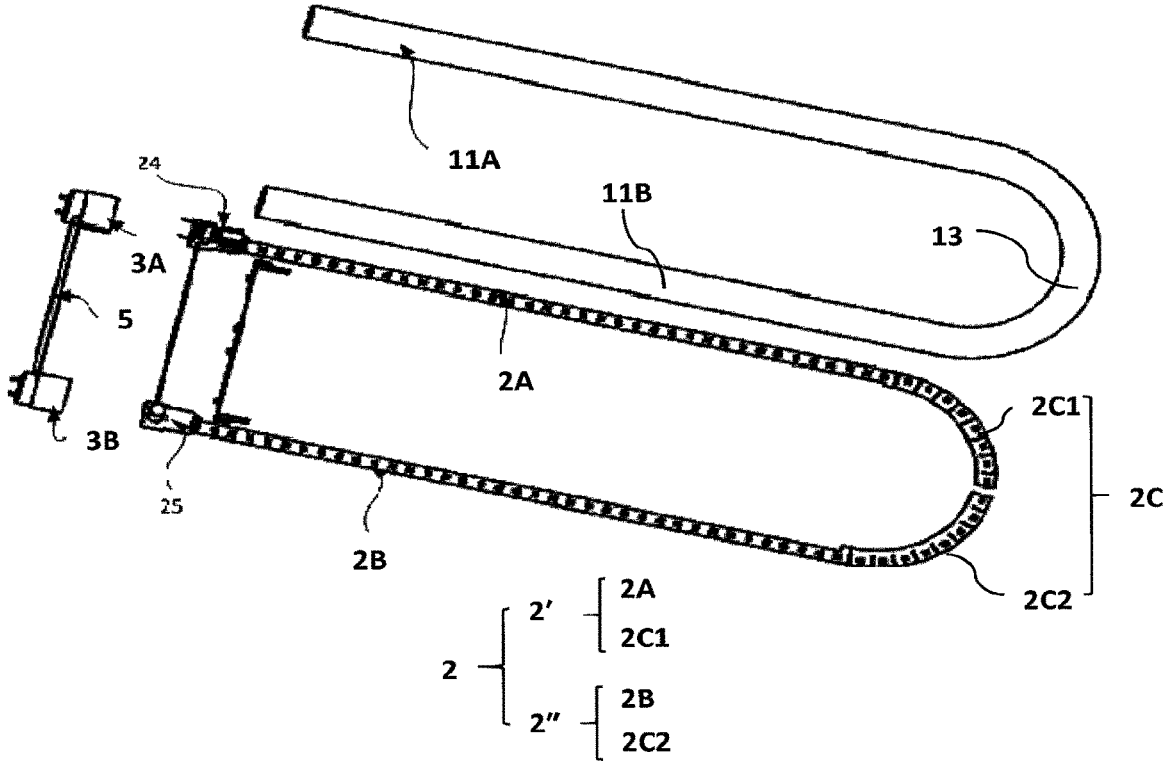
FIG. 36 is an exploded view of the curved LED tubular lamp as illustrated in FIGS. 34 and 35.

As illustrated in FIGS. 34 and 35, the LED light board 2 is a flexible circuit board comprising a first light bar 2A with at least one LED formed thereon, a second light bar 2B with at least one LED formed thereon, and a middle connecting segment 2C with at least one LED formed thereon connected with the first light bar 2A and the second light bar 2B. The LEDs on the LED light board 2 can be arranged in a single row or arranged in a matrix. The first light bar 2A is primarily installed in the first straight tube 11A, the second light bar 2B is primarily installed in the second straight tube 11B, and the middle connecting segment 2C is primarily in the curved part 13. The first light bar 2A and the second light bar 2B of the LED light board 2 may extend along the same direction and may be respectively attached on the first inner wall 111 and the second inner wall 121, thus, there is no substantial difference in length between the first light bar 2A and the second light bar 2B, so the warpage of the LED light board 2 can be avoided. The first light bar 2A and the second light bar 2B of the LED light board 2 are attached onto the first inner wall 111 and the second inner wall 121 by a glue to make the LEDs formed thereon to face outward the inner walls 111 and 121. According to other embodiments of this invention, the first light bar 2A and the second light bar 2B of the LED light board 2 can also be attached onto the first inner wall 111 and the second inner 121 by other methods. If the LEDs exist in the first straight tube 11A, the second straight tube 11B and the curved part 13 of the lamp tube 1, the light can be emitted out of the first straight tube 11A, the second straight tube 11B and the curved part 13 of the lamp tube 1. As shown in FIGS. 34, and 35, the LEDs are facing the outer area (not labeled) composed of the first outer wall 112, the second outer wall 122 and the third outer wall 132. Accordingly, this disposition not only achieve a whole illuminating structure with an enhanced lighting effect but also resolve the warpage problem suffered by the LED light board 2.

Figure 37:
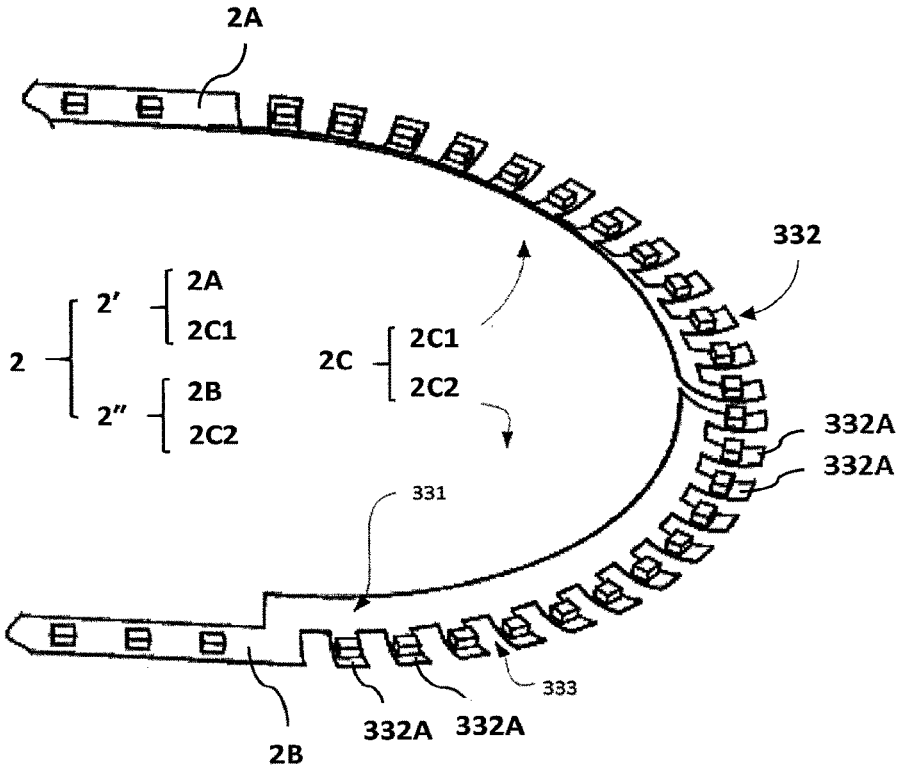
FIG. 37 is an enlarged perspective view of a LED light board applied in the curved LED tubular lamp as illustrated in FIG. 36.

As illustrated in FIG. 37, the first light bar 2A and the second light bar 2B are primarily installed between the inner area and the outer area of the first straight tube 11A and the second straight tube 11B, and the middle connecting segment 2C is compatibly installed in the curved part 13. The middle connecting segment 2C comprises at least one fitting part 331 attached on the inner wall 131 of the curved part 13 and at least one placing part 332 with at least one LED 40 formed thereon installed between the inner wall 131 and the outer wall 132, wherein the fitting part 331 and the placing part 332 both extend in the same direction and the placing part 332 may be wider than the fitting part 331. Also, the middle connecting segment 2C may be wider than the first linear straight lighting part 2A and the second linear straight lighting part 2B. The warpage of the LED light board 2 happened in the curved part 13 of the lamp tube 1 can be avoided by forming the fitting part 331 in the middle connecting segment 2C to make the middle connecting segment 2C be tightly attached onto the inner wall 131 of the curved part 13.

As illustrated in FIG. 37, in order to facilitate the placement of the LEDs 40 and ensure the LED light board 2 not to be warped, the placing part 332 may be designed to be wider than the fitting part 331. The placing part 332 of this embodiment may be perpendicular to the fitting part 331. Of course, the placing part 332 may also not be perpendicular to the fitting part 331 and have a suitable angle therebetween to overcome the warpage of the LED light board 2. The placing part 332 and the fitting part 331 along the latitudinal directional of the LED light board 2 can be smoothly transited, for example curvedly transited, and vertically transited can also alternatively chosen. Besides, in order to avoid the warpage of the LED light board 2, the placing part 332 can preferably comprises a plurality of placing pieces 332A spaced with each other to ensure the leveling and the lighting performance of the LED light board 2 during curvedly extending. Each placing piece 332A comprises at least one LED 40 as illustrated in FIG. 37.

Figure 39:
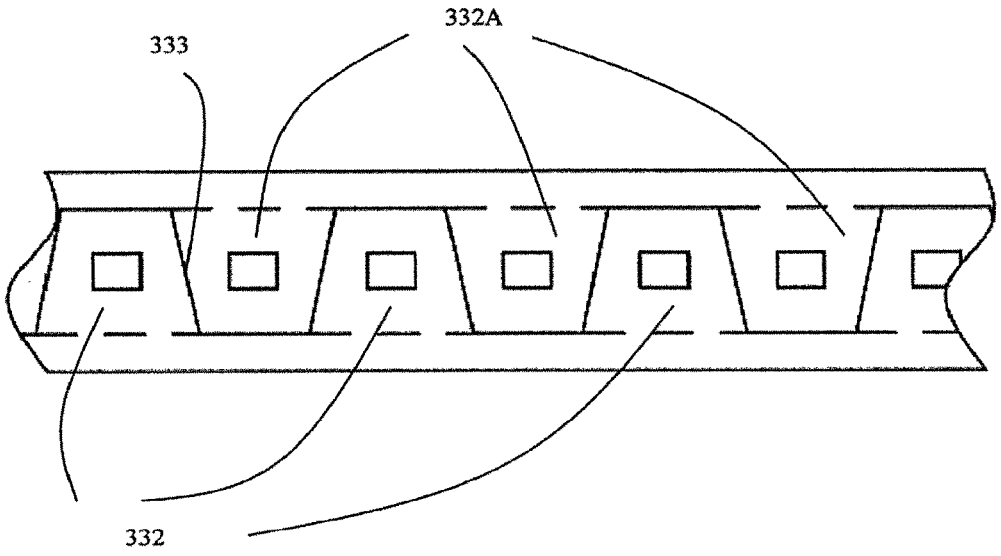
FIG. 39 is a LED light board for the curved LED tubular lamp of the embodiment 5 of this invention.

According to another embodiment of this invention, as shown in FIG. 39, the spacer 333, i.e, notches between two adjacent placing pieces 332 and each spacer 333 are designed of substantially the same shapes to increase the utilization percentage of the raw material. As illustrated in FIG. 39, the LED light board 2 having a plurality of placing pieces 332, and another LED light board having a plurality of placing pieces 332A can be manufactured at the same time by only one dicing process with minimum raw material.

Moreover, in order to facilitate the installing of a longer LED light board 2 into the LED tubular lamp tube 1, the middle connecting segment 2C used to connect the first light bar 2A and the second light bar 2B is separated into a first middle connecting segment 2C1 and a second middle connecting segment 2C2, wherein the first middle connecting segment 2C1 and the first light bar 2A are joined to formed a first LED light board 2', and the second middle connecting segment 2C2 and the second light bar 2B are joined to formed a second LED light board 2". Accordingly, the first LED light board 2' and the second LED light board 2" can be respectively inserted into the first straight tube 11A and the second straight tube 11B from the same ends thereof. Furthermore, the length of the first LED light board 2' can be equal or not equal to that of the second LED light board 2", and the separation part of the first LED light board 2' and the second LED light board 2" is located within the curved part 13.

Figure 38:
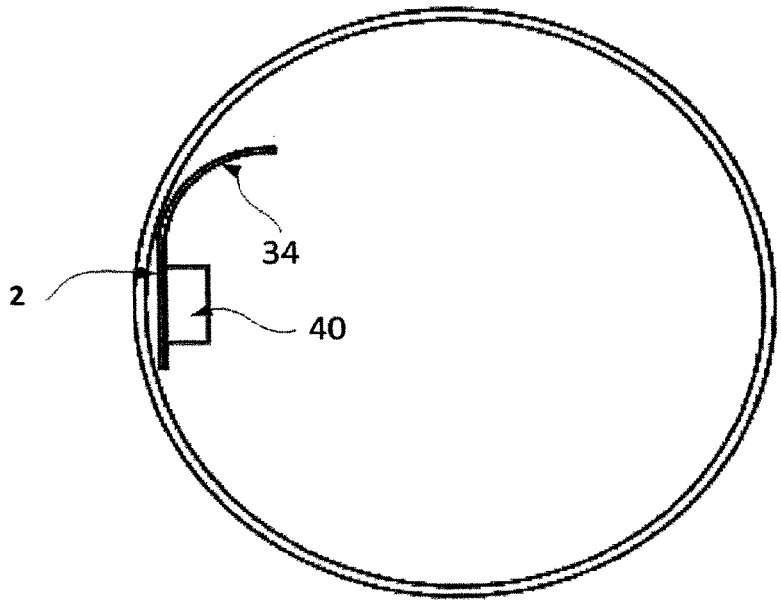
FIG. 38 is cross-sectional view of the curved LED tubular lamp illustrating the LED light board attached on the inner surface of the curved lamp tube as illustrated in FIG. 36.

The LED light board 2 further may comprises a reflector 34 extended from the fitting part 331 or the placing piece 332 to reflect the light emitted by at least one of the LEDs 40 to enhance the luminance of the curved LED tubular lamp, wherein the reflector 34 can be formed by coating a reflecting material on the upper surface of the LED light board 2. As illustrated in FIG. 38, the LED light board 2 comprises a base (not labeled) for forming a LED 40 thereon, and a reflector 34 extended from one end of the base (not labeled).

Furthermore, the light efficiency of the LED tubular lamp can be enhanced by forming the LEDs 40 on one edge of the LED light board 2 where is adjacent to the base (not labeled) mentioned above, and forming the reflector 34 on the other edge of the LED light board 2 to make the reflector 34 bend toward at least one of the LEDs 34. The reflector 34 can be bent in many ways, for example be bent along a folded line (i.e. the cross-sectional view is a folded line) or be bent along a curve (i.e. the cross-sectional view is a curve), and preferable be bent along a curve.

Figure 40:
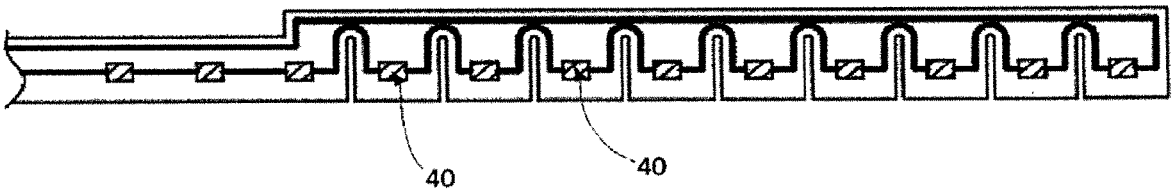
FIG. 40 is a plain view of a LED light board with a plurality of LEDs formed thereon and interconnected in series for the curved LED tubular lamp of the embodiment 5 of this invention.

Furthermore, the difficulty of layout resulting from the narrow LED light board 2 can be overcome by interconnecting the LEDs 40 in series as illustrated in FIG. 40. When the LED light board 2 is a single piece, the LEDs 40 formed thereon are all interconnected in series; when the LED light board 2 is consisted of the first LED light board 2' and the second LED light board 2", the LEDs 40 formed thereon are respectively interconnected in series.

It should be understood that the relation between a pair parts, e.g. a first part and a second part in this invention, for example, the first rear supporter 12A' and the second rear supporter 12B' in FIG. 9-13; the first curved part 51 and the second curved part 51 in FIG. 15-21; the curved upper unit 31 and the curved lower unit 32, should be construed as just "one" and "the other", each feature described herein is independent and not limited to being belong to specific one of the pair parts. For example, as shown in FIG. 19, the positioning pillars 513 and the hooks 517 are disposed at the same side (i.e. the first curved part 51), the positioning caps 523 and the buckles 526 are disposed at the same side (i.e. the second curved part 52) though, the position pillars 513 can be at the same side with the buckles 526, or even be disposed at a curved part without any hooks/buckles.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A curved LED tubular lamp, comprising:

a curved lamp tube having two straight segments and a curve segment disposed between the two straight segments; and at least one flexible substrate having a plurality of LEDs mounted thereon, the flexible substrate being disposed in at least the curve segment and comprising a fitting part and a placing part on which the LEDs are mounted; wherein a reflector extends from one of the fitting part and the placing part to reflect the light emitted by at least one of the LEDs to enhance the luminance of the curved LED tubular lamp;

wherein each of the two straight segments and the curve segment have the plurality of LEDs disposed therein, and wherein the flexible substrate has a plurality of spacers to form notches thereon.

2. The curved LED tubular lamp as claimed in claim 1, wherein the fitting part is attached on the inner wall of the curve segment of the curved lamp, and the placing part includes a plurality of placing pieces with at least one LED mounted thereon.

3. The curved LED tubular lamp as claimed in claim 2, wherein the placing pieces and the spacers have the same shape.

4. The curved LED tubular lamp as claimed in claim 1, wherein the flexible substrate is separated into at least two segments.

5. The curved LED tubular lamp as claimed in claim 1, wherein the curved LED tubular lamp further comprises one or two driving circuits, disposed in one or both of the straight segments of the curved LED tubular lamp.

6. The curved LED tubular lamp as claimed in claim 1, wherein the curved LED tubular lamp is assembled with two straight tubes and a rear supporter disposed between the two straight tubes, and the rear supporter is assembled from two pieces respectively having a protruded edge and a trench extending along the edge thereof.

* * * * *